US008459833B2

(12) United States Patent
Campbell et al.

(10) Patent No.: US 8,459,833 B2
(45) Date of Patent: Jun. 11, 2013

(54) CONFIGURABLE LIGHT EMITTING DIODE LIGHTING UNIT

(75) Inventors: Gregory Campbell, Walpole, MA (US); Yvan Hamel, Laval (CA)

(73) Assignee: Lumenpulse Lighting, Inc. (CA)

( * ) Notice: Subject to any disclaimer, the term of this patent is extended or adjusted under 35 U.S.C. 154(b) by 0 days.

(21) Appl. No.: 13/345,138

(22) Filed: Jan. 6, 2012

(65) Prior Publication Data

US 2012/0287627 A1 Nov. 15, 2012

Related U.S. Application Data

(60) Provisional application No. 61/485,904, filed on May 13, 2011.

(51) Int. Cl.
*F21V 1/00* (2006.01)

(52) U.S. Cl.
USPC ..... 362/237

(58) Field of Classification Search
USPC ..... 362/227, 231, 235, 238–240, 236, 362/237
See application file for complete search history.

(56) References Cited

U.S. PATENT DOCUMENTS

| | | | | |
|---|---|---|---|---|
| 6,773,139 | B2 * | 8/2004 | Sommers | 362/237 |
| 6,851,831 | B2 * | 2/2005 | Karlicek, Jr. | 362/249.06 |
| 7,274,302 | B2 | 9/2007 | Stevenson et al. | |
| 7,798,684 | B2 | 9/2010 | Boissevain | |
| 2005/0122229 | A1 | 6/2005 | Stevenson et al. | |
| 2005/0265024 | A1 | 12/2005 | Luk | |
| 2007/0051964 | A1 | 3/2007 | Owen et al. | |
| 2008/0080196 | A1 | 4/2008 | Ruud et al. | |
| 2008/0089060 | A1 * | 4/2008 | Kondo et al. | 362/231 |
| 2008/0285271 | A1 | 11/2008 | Roberge et al. | |
| 2009/0086491 | A1 | 4/2009 | Ruud et al. | |
| 2009/0196064 | A1 | 8/2009 | Kracker et al. | |
| 2009/0237923 | A1 | 9/2009 | Zheng | |
| 2009/0284976 | A1 | 11/2009 | Storch et al. | |
| 2010/0091492 | A1 | 4/2010 | Simon | |
| 2010/0128479 | A1 | 5/2010 | Biebl et al. | |
| 2010/0176706 | A1 | 7/2010 | Fu et al. | |
| 2010/0188018 | A1 | 7/2010 | Salm | |
| 2010/0259200 | A1 | 10/2010 | Beausoleil | |

(Continued)

FOREIGN PATENT DOCUMENTS

| | | |
|---|---|---|
| EP | 1 693 615 A1 | 8/2006 |
| KR | 20-0447539 Y1 | 2/2010 |

(Continued)

*Primary Examiner* — Julie Shallenberger
(74) *Attorney, Agent, or Firm* — Pierce Atwood LLP; Joseph M. Maraia

(57) ABSTRACT

A light emitting diode (LED) lighting unit including power supply housing accommodating a power supply and an LED array housing defining an internal compartment and a lens sealing the internal compartment. A different respective LED array is mounted on at least one of a number of common printed circuit boards accommodated within the internal compartment. The different LED arrays provide different illumination, controlling one or more illumination features such as beamwidth, color and color temperature. Physical isolation is also provided between the LED array housing and the power supply housing to allow for controlled or otherwise restricted access to one or more of the different housings. In at least some embodiments, one or more of the LED array housing and power supply housing are configured with a centrally located chimney, drawing in cooling air from a space provided between the to housings to facilitate cooling of the lighting unit.

16 Claims, 16 Drawing Sheets

U.S. PATENT DOCUMENTS

| | | | | |
|---|---|---|---|---|
| 2010/0328951 | A1 | 12/2010 | Boissevain | |
| 2011/0063843 | A1 | 3/2011 | Cook | |
| 2011/0080740 | A1 | 4/2011 | Allen et al. | |
| 2011/0121749 | A1 | 5/2011 | Kubis | |
| 2012/0063135 | A1* | 3/2012 | Jurik et al. | 362/249.02 |
| 2012/0250321 | A1 | 10/2012 | Blincoe et al. | |

FOREIGN PATENT DOCUMENTS

| | | | |
|---|---|---|---|
| KR | 10-0997746 | B1 | 12/2010 |
| WO | 2009/081382 | A1 | 7/2009 |
| WO | 2010/058325 | A1 | 5/2010 |

* cited by examiner

FIG. 1A
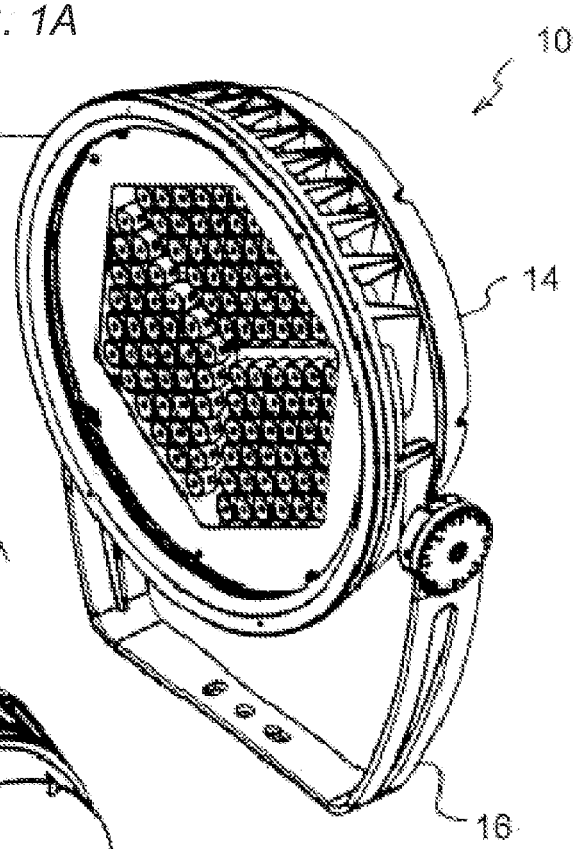
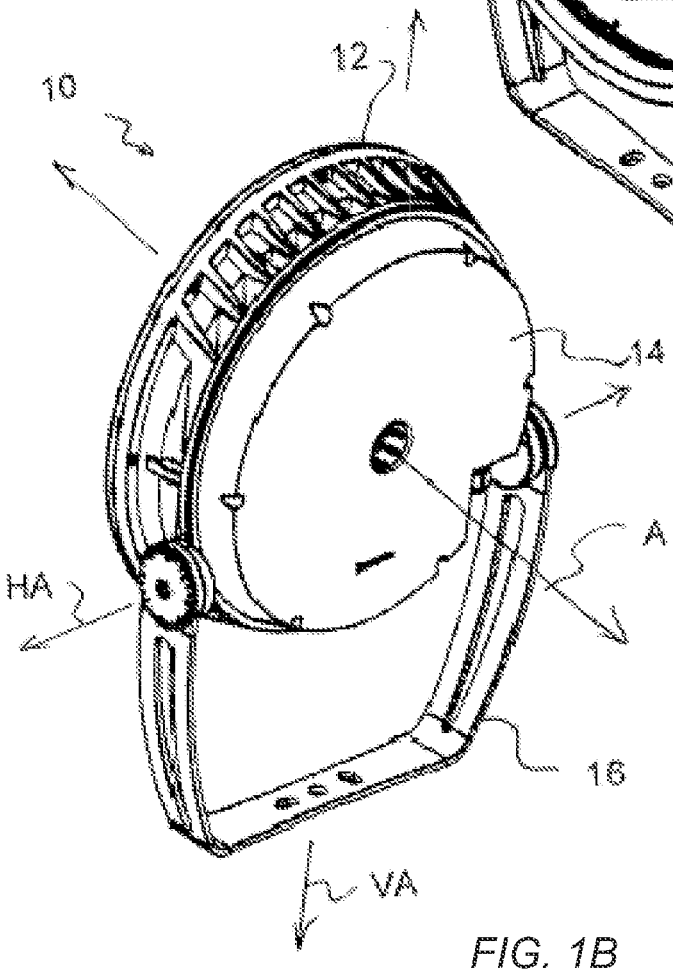
FIG. 1B

FIG. 2B
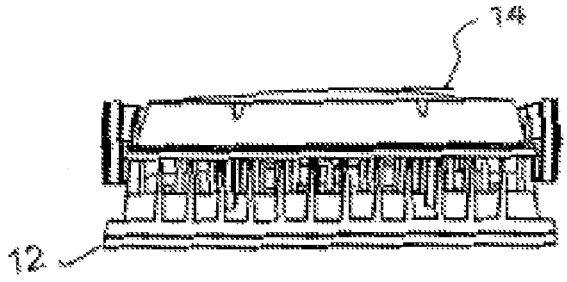
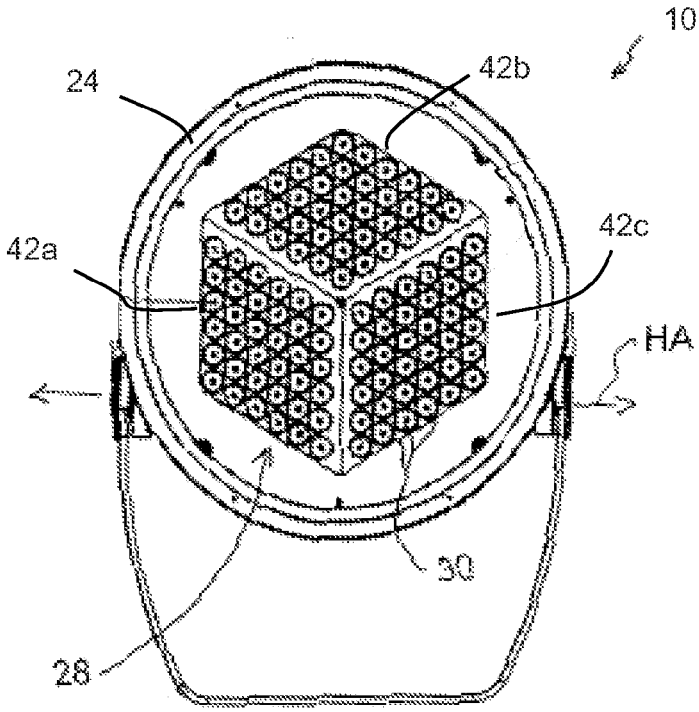
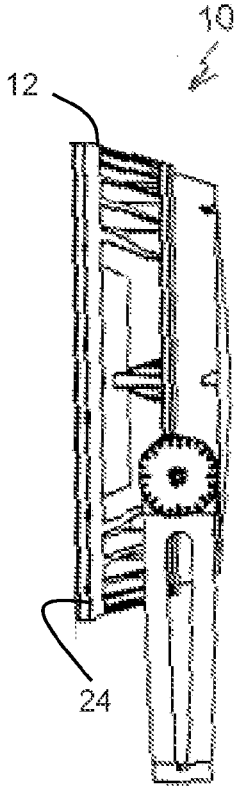
FIG. 2A
FIG. 2C

CONFIGURABLE LIGHT EMITTING DIODE LIGHTING UNIT

RELATED APPLICATIONS

This application claims the benefit of U.S. Provisional Application No. 61/485,904, filed May 13, 2011. The entire teachings of the above application are incorporated herein by reference.

BACKGROUND

1. Technical Field

This application relates generally to the field of lighting. More particularly, this application relates to the technology of high power light emitting diode (LED) lighting units, e.g., providing approximately 9,000 lumens of total illumination at 150 watts power dissipation, and, in particular, to a higher power LED lighting unit for indoor and outdoor lighting functions, such as architectural lighting, having a dynamically programmable single or multiple color array of high power LEDs and improved heat dissipation characteristics.

2. Background Information

Developments in LED technology have resulted in the development of "high powered" LEDs having light outputs on the order of, for example, 70 to 80 lumens per watt, so that lighting units including arrays of high powered LEDs have proven practical and suitable for high powered indoor and outdoor lighting functions, such as architectural lighting. Such high powered LED array lighting units have proven advantageous over traditional and conventional lighting device by providing comparable illumination level outputs at significantly lower power consumption. Lighting units including arrays of higher powered LEDs are further advantageous in providing simple and flexible control of the color or color temperature of the lighting units. That is, and for example, high powered LED lighting units may include arrays of selected combinations of red, green and blue LEDs and white LEDs having different color temperatures. The color or color temperature output, of such an LED array, may then be controlled by dimming control of the LEDs of the array so that the relative illumination level outputs, of the individual LEDs in the array, combine to provide the desired color or color temperature for the lighting unit output.

A recurring problem with such higher powered LED array lighting units, however, is the heat generated by such high powered LED arrays, which often adversely effects the power and control circuitry of the lighting units and the junction temperatures of the LEDs, resulting in shortened use life and an increased failure rate of one or more of the power and control circuitry and the LEDs. This problem is compounded by the heat generated by, for example, the LED array power circuitry and is particularly compounded by the desire for LED lighting units that are compact and of esthetically pleasing appearance as such considerations often result in units having poor heat transfer and dissipation characteristics with consequently high interior temperatures and "hot spots" or "hot pockets."

The present invention provides a solution to these and related problems of the prior art.

SUMMARY

Wherefore, it is an object of the present invention to overcome the above mentioned shortcomings and drawbacks associated with the prior art.

An object of the present invention is to provide a higher power LED lighting unit approaching about 9,000 lumens of total illumination at 150 watts power dissipation.

Another object of the present invention is to provide an improved heat transfer element, which further improves the conduction of heat, generated by the LEDs and through and out of the LED lighting unit so that the LED lighting unit operates at a cooler temperature and thereby reduces the possibility or likelihood that the generated heat from the LEDS will adversely affect the power supply and/or the associated electronic circuitry.

A further object of the present invention is to provide a centrally located chimney, formed in at least one of a rear surface of the power supply housing, and a front surface of the LED array housing, which directly communicates with the air flowing into and through the heat transfer element and thereby facilitates improved convection airflow into and out of the LED lighting unit, which provides a more efficient cooling of the LED lighting unit and thereby increases the durability of the LED lighting unit incorporating the same.

Another object of the present invention is to provide the chimney with a reduced area throat section as well as a suitable cross sectional airflow area which avoids restricting pass natural convention flow of air into and through the chimney and thereby improves the overall cooling of the LED lighting unit and, in turn, the LEDs and the internal components accommodated within the LED lighting unit.

Another object of the present invention is to provide a standardized configuration in which various subassemblies or modules can configured in the LED lighting unit to achieve a desired illumination.

Yet another object of the present invention is to provide a lighting unit configuration in which various LED subassemblies or modules can be physically accessed, for example during repair, without disturbing other subassemblies, such as power supplies and/or control circuitry.

The present invention is directed to a lighting unit including a thermally conductive array housing and having an array of LEDs and LED control circuits mounted on a first surface of a printed circuit board, and a heat transfer element located on a second surface of the printed circuit board and forming a thermally conducting path between the array of LEDs and a rear side of the LED array housing, and a power supply housing spaced apart from the read side of the LED array housing and including a power supply. The LED array housing includes more than one vertically oriented (e.g., with respect to a plane of the LED array) heat dissipation elements located in an airflow space between the LED array housing and power supply housing and extending toward but not touching a front side of the power supply housing. The heat dissipating elements, the rear side of the LED array housing and the front side of the power supply housing form multiple convective circulation air passages for the convective dispersal of heat from the heat dissipating elements with thermal isolation gaps between the heat dissipation elements and the power supply housing to thermally isolate the power supply housing from the LED array housing and LED array.

The LED array may include a selected combination of high powered LEDs selected from among at least one of red LEDs, green LEDs, blue LEDs and white LEDs of various color temperatures and the control circuits may include dimming circuits to control a light spectrum and illumination level output of the array of LED by controlling the power levels delivered to the diodes of the LED array.

The LED array housing and the power supply housing are mounted to each other by one or both of a conduit providing a path for power cabling between the power supply housing and the LED array housing and thermally isolating support posts.

In at least some embodiments the heat dissipation elements extend in parallel across a width of a rear surface of the LED array housing as elongated, generally rectangular fins having a major width extending across a rear side of the LED array housing and tapering to a lesser width extending toward the power supply housing and of a height extending generally from the rear side of the LED array housing and toward a front side of the power supply housing with a thermally isolating gap between the heat dissipation elements and the front side of the power supply housing.

In at least some embodiments, the LED array housing and the power supply housing are each substantially cylindrical in shape with a substantially circular transverse cross section having a diameter greater than the axial length of the housing and a circumferential side wall sloping from a first diameter at the front side of the respective housing to a lesser second diameter at the rear side of the respective housing.

In one aspect, at least one embodiment described herein provides a solid-state lighting unit including a solid-state array housing defining an internal compartment and having at least one transparent lens for sealing the internal compartment. The lighting unit also includes a number of solid-state lighting circuit card assemblies disposed within the solid-state array housing. Each circuit card assembly includes a common circuit card and a respective number of solid state lighting elements. A respective number of solid state lighting elements of at least one circuit card assembly differ in performance with respect to a respective number of solid state lighting elements of at least another circuit card assembly of the number of solid-state lighting circuit card assemblies.

In another aspect, at least one embodiment described herein provides a process for assembling a solid-state lighting unit. The process includes providing a solid-state array housing defining an internal compartment and having at least one transparent lens for sealing the internal compartment. A number of common solid-state lighting circuit cards are also provided. At least one circuit card of the number of common solid-state lighting circuit cards is populated with a first number of solid-state lighting elements. At least another circuit card of the number of common solid-state lighting circuit cards is populated with a second number of different solid-state lighting elements. The populated circuit cards are disposed within the solid-state array housing.

BRIEF DESCRIPTION OF THE DRAWINGS

The present invention is further described in the detailed description which follows, in reference to the noted drawings by way of non-limiting examples of exemplary embodiments of the present invention, in which like reference numerals represent similar parts throughout the several views of the drawings, and wherein:

FIGS. 1A and 1B are respectively front and rear perspective views of an embodiment of a LED lighting unit;

FIGS. 2A, 2B and 2C are respectively front, top and right side elevational views of the LED lighting unit of FIGS. 1A and 1B;

FIG. 2D is a diagrammatic cross sectional view of FIG. 2C, while

DESCRIPTION OF THE PREFERRED EMBODIMENTS

Figure 2D:
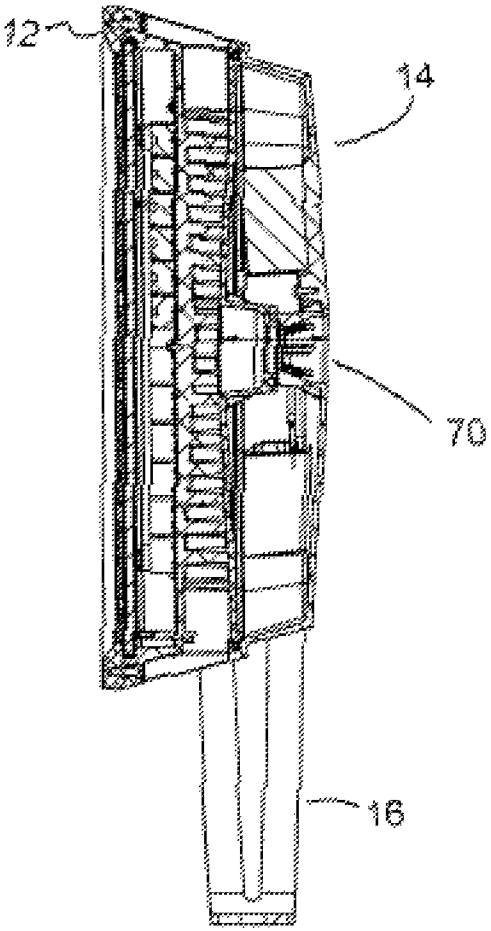
Figure 2E:
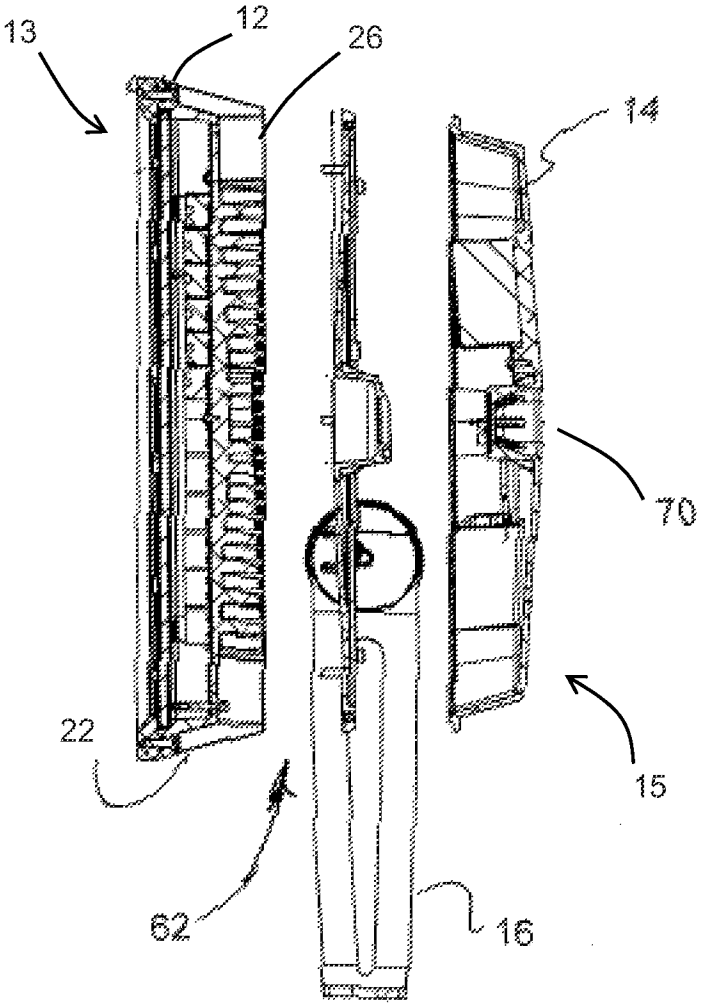
FIG. 2E is a diagrammatic exploded cross sectional view of FIG. 2C.

In the following detailed description of the preferred embodiments, reference is made to accompanying drawings, which form a part thereof, and within which are shown by way of illustration, specific embodiments, by which the invention may be practiced. It is to be understood that other embodiments may be utilized and structural changes may be made without departing from the scope of the invention.

The particulars shown herein are by way of example and for purposes of illustrative discussion of the embodiments of the present invention only and are presented in the case of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in that how the several forms of the present invention may be embodied in practice. Further, like reference numbers and designations in the various drawings indicate like elements.

Referring first to FIGS. 1A and 1B, an LED lighting unit 10, according to the invention, is illustrated which includes a solid state LED array assembly, e.g., an LED array assembly 13, positioned and oriented at a front of the lighting unit 10, and a power supply assembly 15, positioned at a rear of the lighting unit 10, coupled to but located directly behind the LED array assembly 13. The LED array assembly 13 and the power supply assembly 15 of the illustrative embodiment are both generally cylindrical in shape, that is, are of generally circular cross section with a diameter greater than their respective heights and/or thicknesses.

The LED assembly 13 includes a solid-state array housing including, for example LED lighting elements, referred to herein as an LED array housing 12. In an illustrative embodiments, the LED array housing 12 has a front diameter of approximately 17.25 inches and tapers to a rear side diameter of approximately 15.6 inches over a total housing thickness of approximately 3.25 inches. The power supply assembly 15 includes a power supply housing 14, which is spaced apart from a rear surface of the LED array housing 12, for example, by approximately 1.75 inches having a front diameter of approximately 14.9 inches and tapering to a rear side diameter of approximately 14.25 inches over a thickness of approximately 2.8 inches. Both the LED array housing 12 and the power supply housing 14 include a thermally conductive and supportive material, such as cast aluminum, for example, having a wall thickness of about 0.25 to 0.5 inches, provided with a polyester powder coat finish and sealed according to International Safety Standard IP66.

It will be appreciated and understood, however, that in at least some embodiments, the cross sectional shapes of the array housing 12 and the power supply housing 14 are generally defined by the shape of the LED array, which is described in detail in a following description, as are the dimensions of the LED array housing 12 and the power supply housing 14. It will also be understood that other cross sectional and longitudinal shapes, such as square, rectangular or polygonal for example, are possible and fall within the scope of the present invention.

As shown, the lighting unit 10 is typically supported by a conventional mounting bracket 16 which allows for adjustment of the lighting unit as may be beneficial in causing or otherwise directing illumination in a preferred direction. For example, the mounting bracket 16 can allow for vertical rotation of the lighting unit 10 about a horizontal axis HA, which passes through the lighting unit 10 at a location approximately centrally between the LED array housing 12 and the power supply housing 14 at approximately a center of balance of the lighting unit 10. Alternatively or in addition, the mounting bracket 16 can allow for horizontal rotation about a vertical axis VA. It will be understood, however, that a lighting unit 10 may be supported or mounted by any of a wide range of other conventional mounting designs and/or configuration, including both fixed mounts and positional mounts of various types.

Figure 2F:
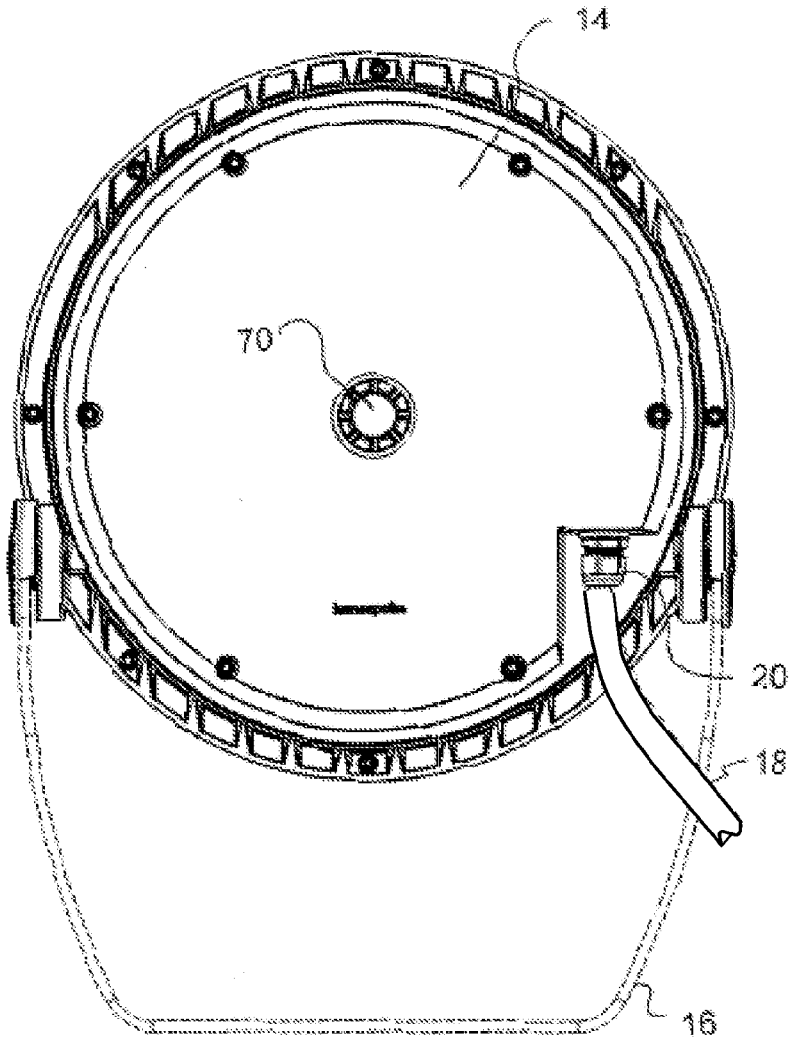
FIGS. 2F and 2G are respectively rear and left side elevational views of the LED lighting unit of FIGS. 1A and 1B, with an embodiment of a mounting bracket shown in dashed lines.
Figure 2G:
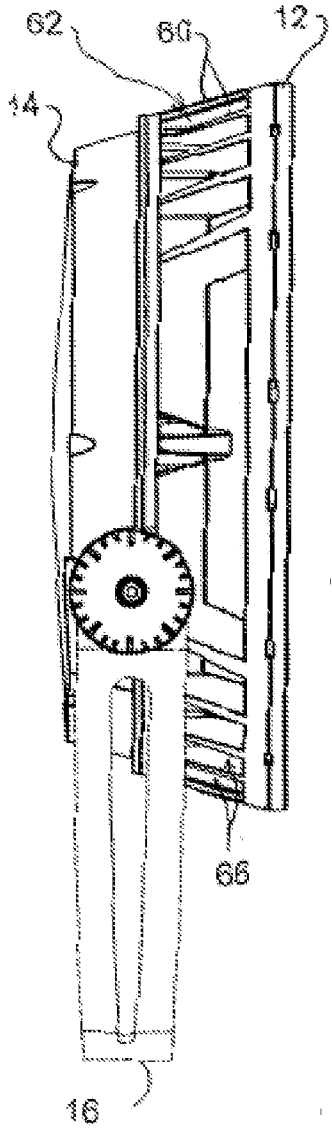

A power/control cable 18 supplies power and control signals to the LED array and enters the lighting unit 10 though a conventional weather tight fitting 20 that is mounted in a side wall of the power supply housing 14 (see FIG. 2F). It is to be appreciated that the power/control cable 18 may include separate power and control cables or a single combined power and control cable. In other embodiments, and in particular embodiments having separate power and control cables, the power cable 18 may enter power supply housing 14 through the power cable fitting 20 while the control cable may enter through a side or a rear wall of the LED array housing 12 via a separate control cable fitting (not shown).

Referring now to FIGS. 2A, 2B, 2C, 2D, 2E, 2F, 2G, 3A and 3B, the LED array housing 12 is shown as being generally frusto-conical in shape, and may also be cylindrical in shape, with a generally circular transverse cross section having a diameter greater than the axial length of the LED array housing 12 and a circumferential side wall 22 that gradually slopes from its full diameter, at the front face 24 of the LED array housing 12, to a smaller diameter forming the rear surface 26 of the LED array housing 12.

The LED array assembly 13 includes a solid state array module, e.g., an LED array 28 including a symmetrically packed array of solid state lighting elements, e.g., LEDs 30 mounted on one or more printed circuit modules 42*a*, 42*b*, 42*c* (generally 42) for generating and forming a desired light beam to be generated and transmitted by the lighting unit 10, when powered, with the LED array 28 being covered and protected by one or more optical/sealing elements 32, such as a transparent lens. The optical/sealing element(s) 32 sealing mate with (FIG. 3A) the front face 24 of the LED array housing 12, in a conventional manner, providing an internal compartment, and sealing the internal components, e.g., the LEDs 30 and the circuit board(s) 38, from the external environment, thereby protecting the LED array 28 as well as the other lighting unit components contained within the LED array housing 12, and may include optical elements for shaping and forming the light beam generated and projected by the LED array 28. For example, such optical/sealing elements 32 may include a beam shaping lens(es), an optical filter(s) of various types, an optical mask(s), a protective transparent cover plate(s), etc.

The power supply housing 14, in turn, contains a power supply 34 that is connected with the power leads of the power/control cable 18 and supplies electrical power outputs to the LED array 28, as discussed in further detail below.

According to the present invention, each of the individual LEDs 30 of the LED array 28 is mounted on a front surface 36 of a printed circuit board 38 (see generally FIGS. 1A, 2A and 3A) that sized and shaped to be accommodated and mounted within the interior compartment 40 defined by the LED array housing 12, i.e., in close abutting and intimate contact with the bottom surface 26 of the LED array housing 12 to facilitate heat transfer thereto. The LEDs 30 include any desired and selected combination of high powered LEDs, such as red, green, blue or white LEDs of various color temperatures, such as 2,700K, 3,000K and/or 4,000K white light LEDs, depending upon the desired output spectrum or spectrums of the LED lighting unit 10.

Figure 3A:
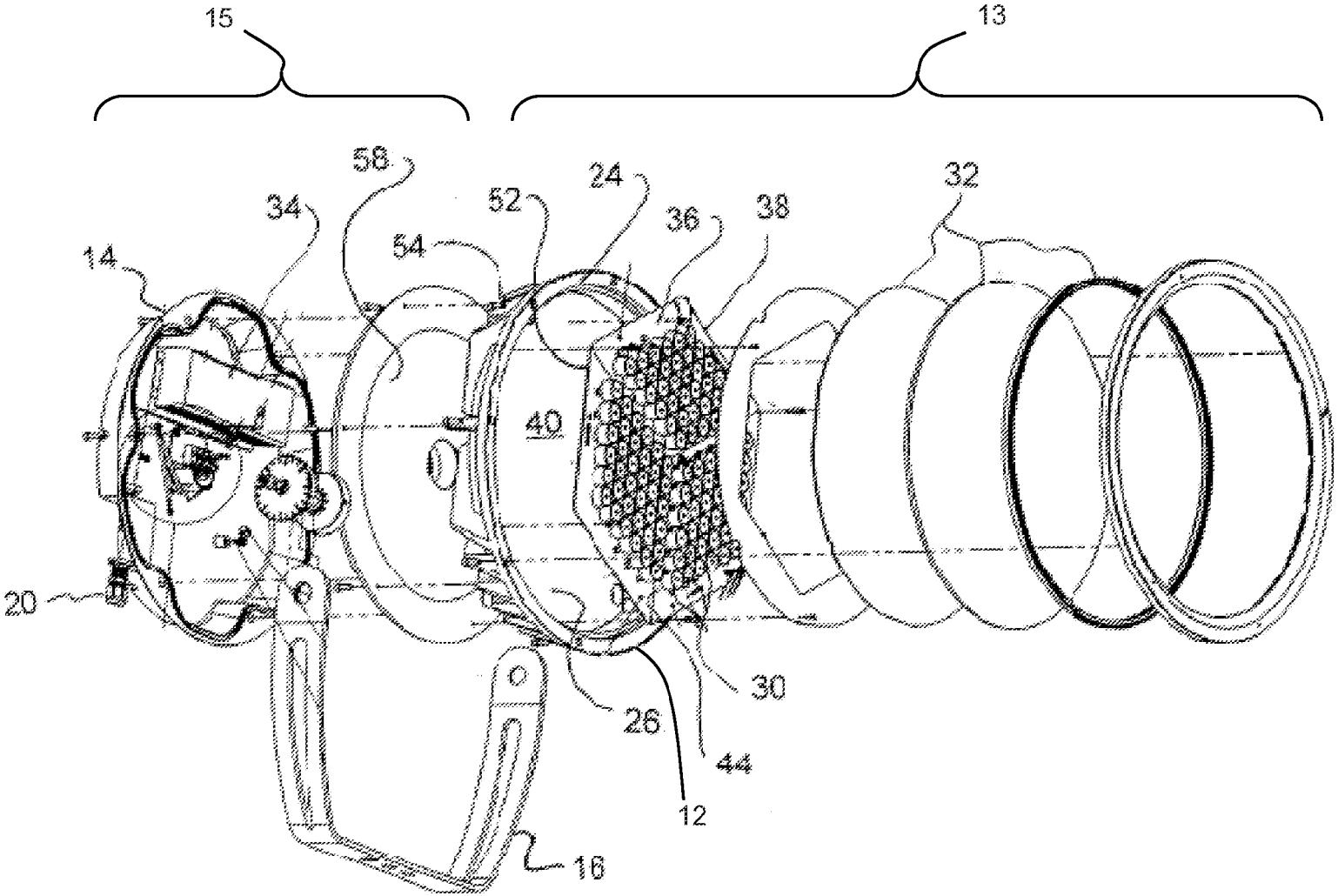
FIG. 3A is an exploded front perspective view of the higher powered LED lighting unit of FIGS. 1A and 1B.

According to one embodiment of the LED lighting unit 10, the LED array 28 includes three separate groups, channels or arrays each including a total of 36 LEDs. The 36 LEDs of each separate group, channel or array are arranged in a 6×6 LED array 42 generally in the shape of a diamond. Each one of the three diamond shaped 6×6 LED arrays 42 are clustered together closely adjacent one another to thereby form a generally hexagonally shaped LED array 28, as shown in FIG. 3A, of 108 LEDs (see FIGS. 1A and 2A, for example). The three separate diamond shaped arrays 42 are located closely adjacent one another and are capable of providing approximately 9,000 lumens of total illumination at 150 watts power consumption with an output beam having a radiating angle of between 6° and 30°, that is, radiating angle somewhere between a narrow spotlight beam and a floodlight beam, depending upon the selection, type and the arrangement of LEDs 30, as described below, as well as the utilized optical elements 32.

It will be appreciated, however, that the LED lighting unit 10 may be constructed with either more or less than 108

LEDs, depending upon the particular illumination application, with any desired combination of LED output colors, e.g., such as red, blue, green, amber, cyan, royal blue, yellow, warm white and cool white, and with greater or lesser output power and power consumption by suitable adaptation of the embodiments described herein, as will be readily understood by and be apparent to those of ordinary skill in the relevant art.

Figure 4:
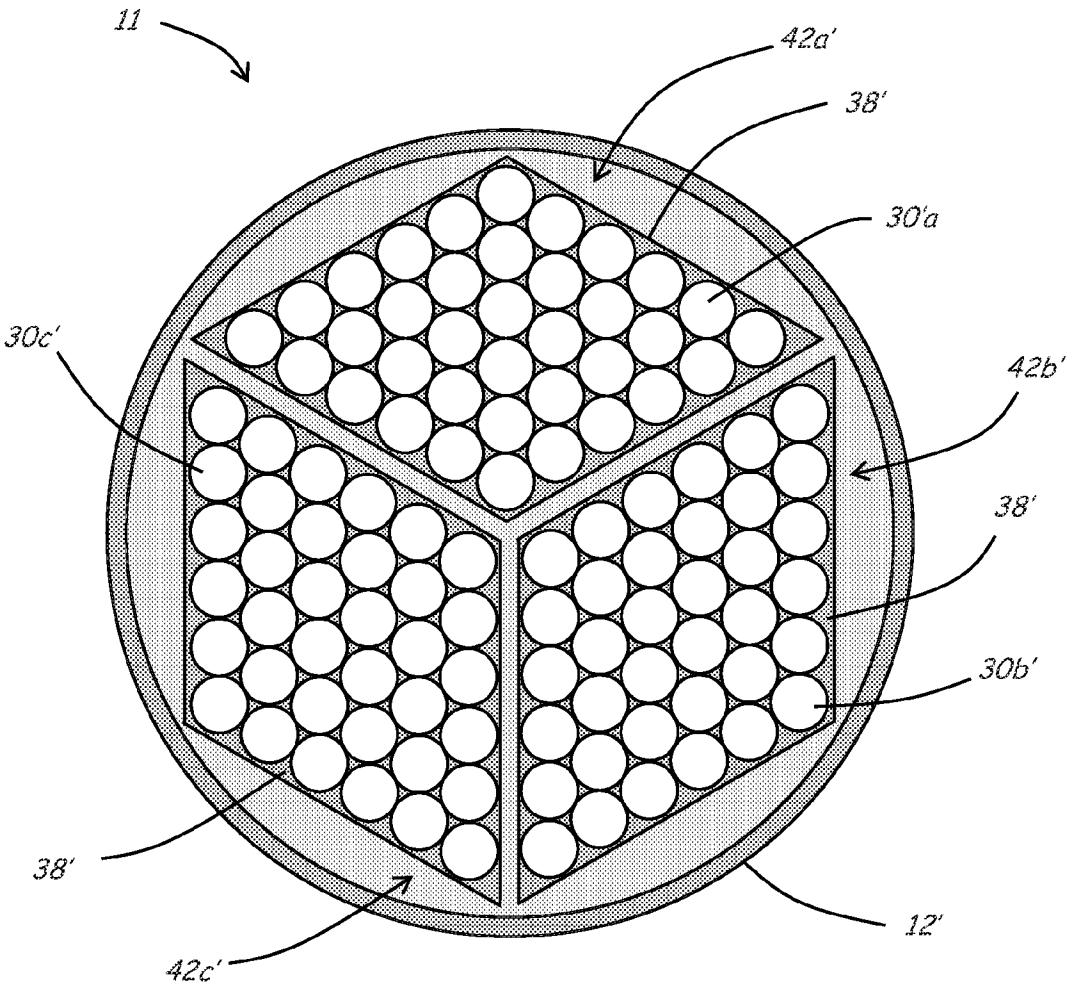
FIG. 4 is a diagrammatic front view of an embodiment of a configurable LED lighting unit.

Another embodiment of a compound solid-state lighting assembly 11 is illustrated in FIG. 4. The compound lighting assembly 11 includes a solid-state array housing 12' defining an internal compartment. In some embodiments, the compound lighting assembly 11 has at least one transparent lens for sealing the internal compartment of the solid-state array housing 12'. The lighting unit 11 includes a number of solid-state lighting circuit card assemblies 42*a'*, 42*b'*, 42*c'* (generally 42') disposed within the solid-state array housing 12'. Each circuit card assembly 42' includes a common circuit card 38' and a respective number of solid state lighting elements 30*a'*, 30*b'*, 30*c'* (generally 30'). In the illustrative embodiments, a respective number of solid state lighting elements 30*a'* of the first card assembly 42*a'* differ in performance with respect to a respective number of solid state lighting elements 30*b'* of the second circuit card assembly 42*b'*, both of which differ in performance with respect to the solid state lighting elements 30*c'* of the third circuit card assembly 42*c'*.

By way of illustrative example, the first circuit card assembly 42*a'* is configured with 36 LED lighting elements 30*a'* having a relatively narrow illumination beamwidth (e.g., 6°). Likewise, the second circuit card assembly 42*b'* is similarly configured with 36 LED lighting elements 30*b'* having a different illumination beamwidth, such as relatively wide beamwidth (e.g., 30°). The third circuit card assembly 42*c'* is also similarly configured with 36 LED lighting elements 30*c'* having yet another different illumination beamwidth, such as relatively medium beamwidth (e.g., 20°). Such different illumination beamwidths can be provided by the LED lighting elements themselves, optics (e.g., lenses, shrouds) provided in combination with the lighting elements, or some combination of the lighting elements and optics.

Figure 6A:
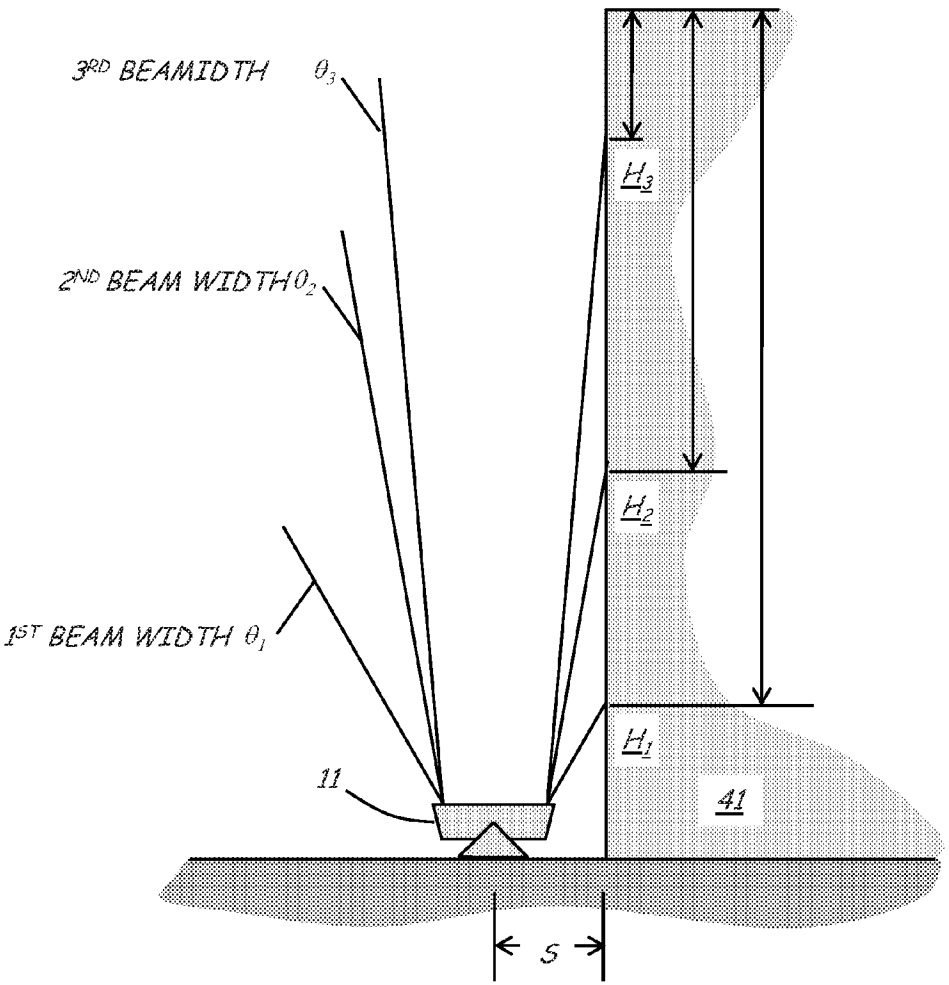
FIG. 6A is a diagrammatic side elevation view of an illumination pattern of an embodiment of a configurable LED lighting unit.
Figure 6B:
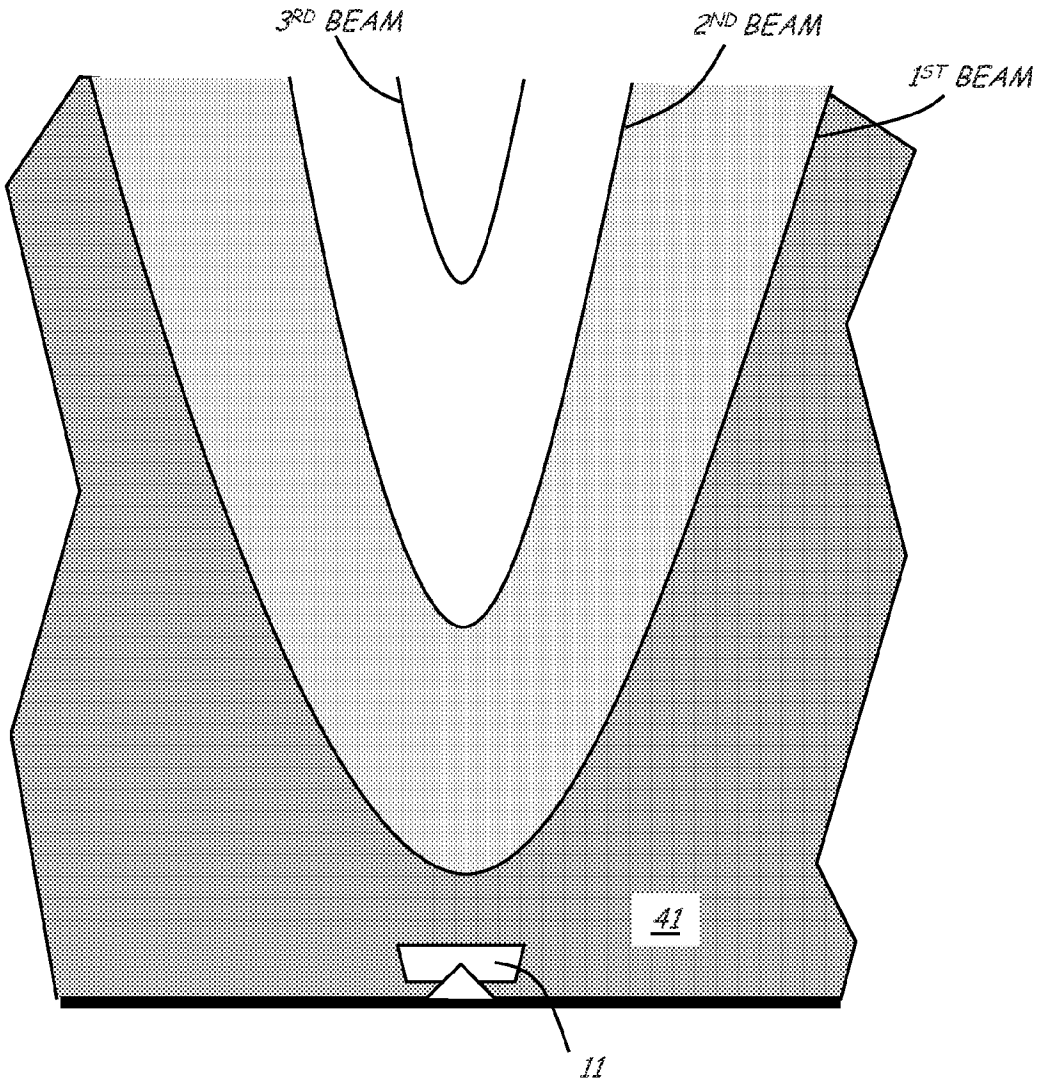
FIG. 6B is a diagrammatic front elevation view of the illumination pattern illustrated in FIG. 6A.

An example of illumination provided by such a configuration of different beamwidth LED lighting elements within the same lighting unit 11 is illustrated in FIGS. 6A and 6B. In particular, the different beamwidths of illumination originating from a common lighting unit provide a compact profile lighting source configured to provide a wide range of illumination. Such illumination can be advantageous in at least some applications in which a relatively uniform illumination is desired on a given structure, such as a building or other structure (e.g., bridge, sign).

In the illustrative example, an upward illumination is provided by the lighting unit 11 to illuminate the side of a structure 41, such as a building. The relatively wide illumination beamwidth $\theta_1$ (e.g., 30°) illuminates above a relatively low height $H_1$. Likewise, a relatively medium illumination beamwidth $\theta_2$ (e.g., 20°) illuminates above a relatively medium height $H_2$, greater than $H_1$; whereas, a relatively narrow illumination beamwidth $\theta_3$ (e.g., 6°) illuminates above a relatively tall height $H_3$, which is greater than either $H_1$ and $H_2$. A front elevation view of illumination provided by such a configuration is illustrated in FIG. 6B.

Figure 5:
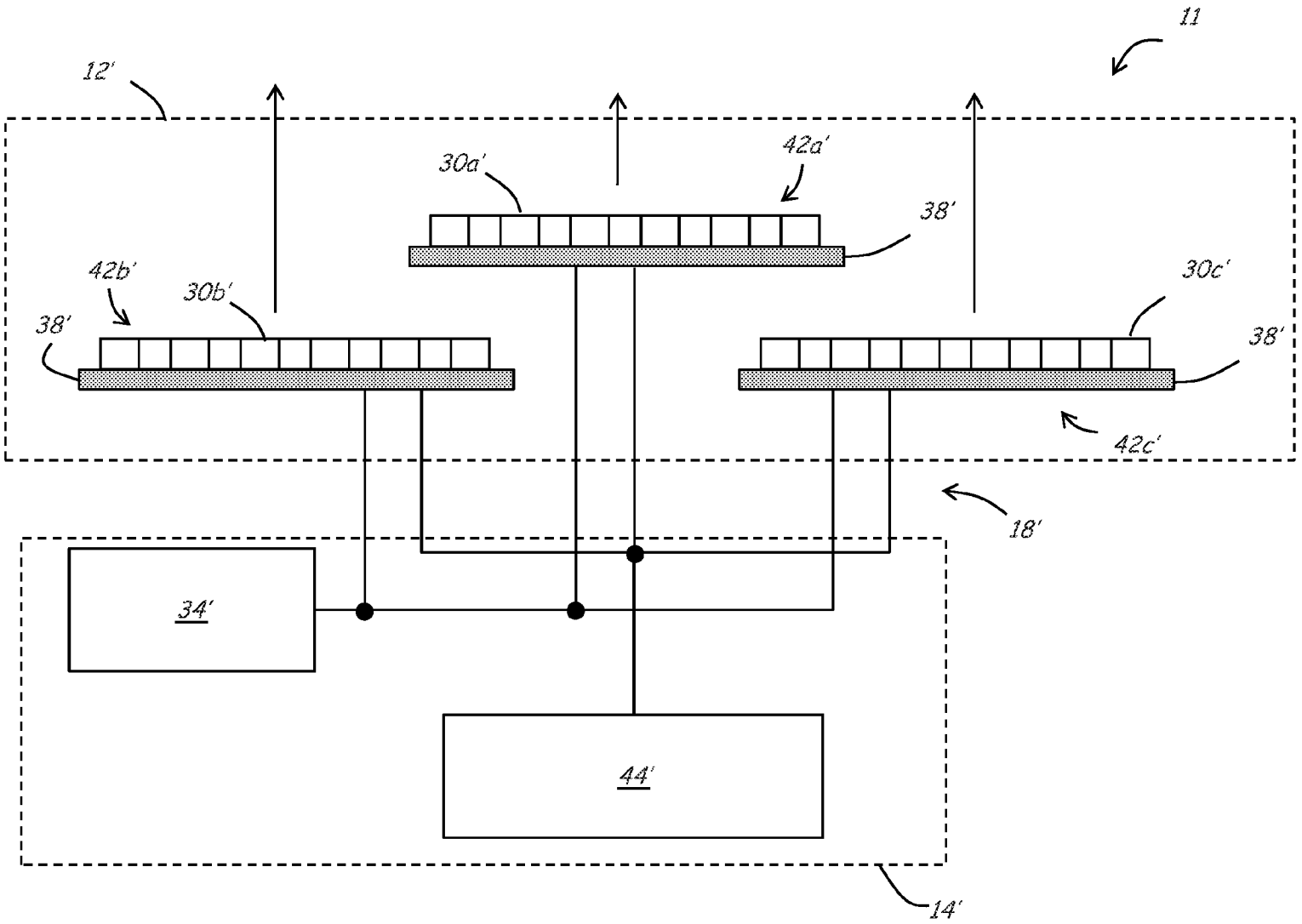
FIG. 5 is a schematic diagram of an embodiment of a configurable LED lighting unit.

Referring next to FIG. 5, a schematic diagram of an embodiment of the configurable LED lighting unit 11 is shown. The lighting unit 11 includes an LED array housing 12' including three lighting circuit card assemblies 42*a'*, 42*b'*, 42*c'*. Each circuit card assembly 42' includes a respective printed circuit board 38', which in at least some embodiments, can be identical, despite differences in illumination provided by the lighting circuit card assemblies 42'. Such common elements enhance manufacturability and tend to reduce production costs. In at least some embodiments, different illumination is provided by populating each respective printed circuit board 38' with different LED lighting elements 30'. Alternatively or in addition, other differing features adapted to alter illumination, such as optical elements (e.g., lenses, shrouds, filters, polarizers), can be combined with the respective circuit card assemblies 42'.

Also shown are a power supply 34' and control circuitry 44' provided within a separate, power supply housing 14'. In the illustrative example, an interior cavity of the power supply housing 14' is physically isolated from the LED array housing 12', such that replacement, reconfiguration, or more generally, physical access to the lighting circuit card assemblies 42' can be accomplished without disturbing either the power supply 34' or the control circuitry 44'. In at least some embodiments, the two separate housings 12', 14' are interconnected by cabling 18' providing one or more of electrical power and control signals between the LED array housing 12' and the power supply housing 14'. Such physical isolation of the different elements of the lighting unit 11 can be advantageous in controlling access, for example, allowing maintenance personnel to access the LED array housing 12' without disturbing or otherwise exposing such personnel to higher voltages that may be present within the power supply housing 14.

Although the illustrative example includes different beamwidths, it is understood that other aspects affecting illumination provided by the solid-state lighting unit 11 can be controlled by selection and/or combination of various lighting elements 30' with differing features within the multiple solid-state lighting circuit card assemblies 42'. Such features can include one or more of illumination color and illumination color temperature. It is also understood that in some embodiments, substantially all of the lighting elements 30' of a particular lighting circuit card assembly 42' can be substantially identical; whereas, in other embodiments, the lighting elements 30' of a particular lighting circuit card assembly 42' may differ. An example of such differences may be a particular combination of different color and/or different color temperature LED lighting elements 30' on one lighting circuit card assembly 42' that differs from a combination of LED lighting elements 30' of any of the other lighting circuit card assemblies 42'.

As known by those of skill in the relevant art, the color or the color temperature output of the LED array 28 may include any desired color combination of LEDs 30 and may be controlled by a dimmer control for the LEDs 30, forming the LED array 28, so that the relative illumination level output of, the individual LEDs 30 in the array, combine to provide the desired color or color temperature for the lighting unit output. According to the present invention, the dimming control of the individual LEDs 30, forming the LED array 28, can be provided by one or more control circuits 44, which are controlled by signals transmitted to each LED lighting unit 10 through the control/power cable 18 according to industry standard protocols, such as and for example, the industry standard DMX512 protocol, the DALI protocol, the digital signal interface (DSI), or the remote device management (RDM) protocol. Such control circuits 44 can be integrated, for example, in the one or more circuit boards 38 of the LED array assembly 13.

As generally illustrated in FIG. 3A, the control circuits 44 for the LEDs 30 of the LED array 28 are mounted on the front surface 36 of the circuit board 38 and are generally disposed circumferentially about the LED array 28. The control leads (not shown), which connect the control outputs of the control circuits 44 to the individual LEDs 30, can also be formed on the front surface 36 of the printed circuit board 38. The power leads (not shown), which connect the power output of the power supply 34 in power supply housing 14 to the control circuits 44 and the LEDs 30, are also coupled to the front surface 36 of the printed circuit board 38 for suitable powering of the various that the LEDs 30.

According to the present invention, the rear surface 26 of the LED array housing 12 generally includes a thermally conductive heat transfer element 50. A rear surface 52 of the printed circuit board 38 is generally provided in intimate contact with the heat transfer element 50 so as to facilitate conduction of the heat, generated by the LEDs 30, from the circuit board 38 and into the heat transfer element 50 for subsequent transferred to surrounding air, as will be discussed below in further detail. During operation of the LED lighting unit 10, the printed circuit board 38, supporting the LED array 28, generally absorbs, transfers and/or otherwise carries away the heat which is generated by the LEDs 30. Accordingly, in such embodiments it is important that the rear surface 52 of the printed circuit board 38 be in thermally conductive contact with the adjacent surface of the heat transfer element 50.

To facilitate the desired heat transfer from the printed circuit board 38, the heat transfer element 50 is preferably manufactured from a thermally conductive material, such as aluminum or similar material or metal which readily conducts heat. When printed circuit board 38 is mounted within the LED array housing 12, an adjacent surface of the heat transfer element 50 is thus located in thermally conductive contact with the rear surface 52 of the printed circuit board 38 and thereby forms a continuous thermally conductive path from the LEDs 30 through the printed circuit board 38 into the heat transfer element 50 to facilitate conduction thereto of heat generated from the LEDs 30.

Figure 3B:
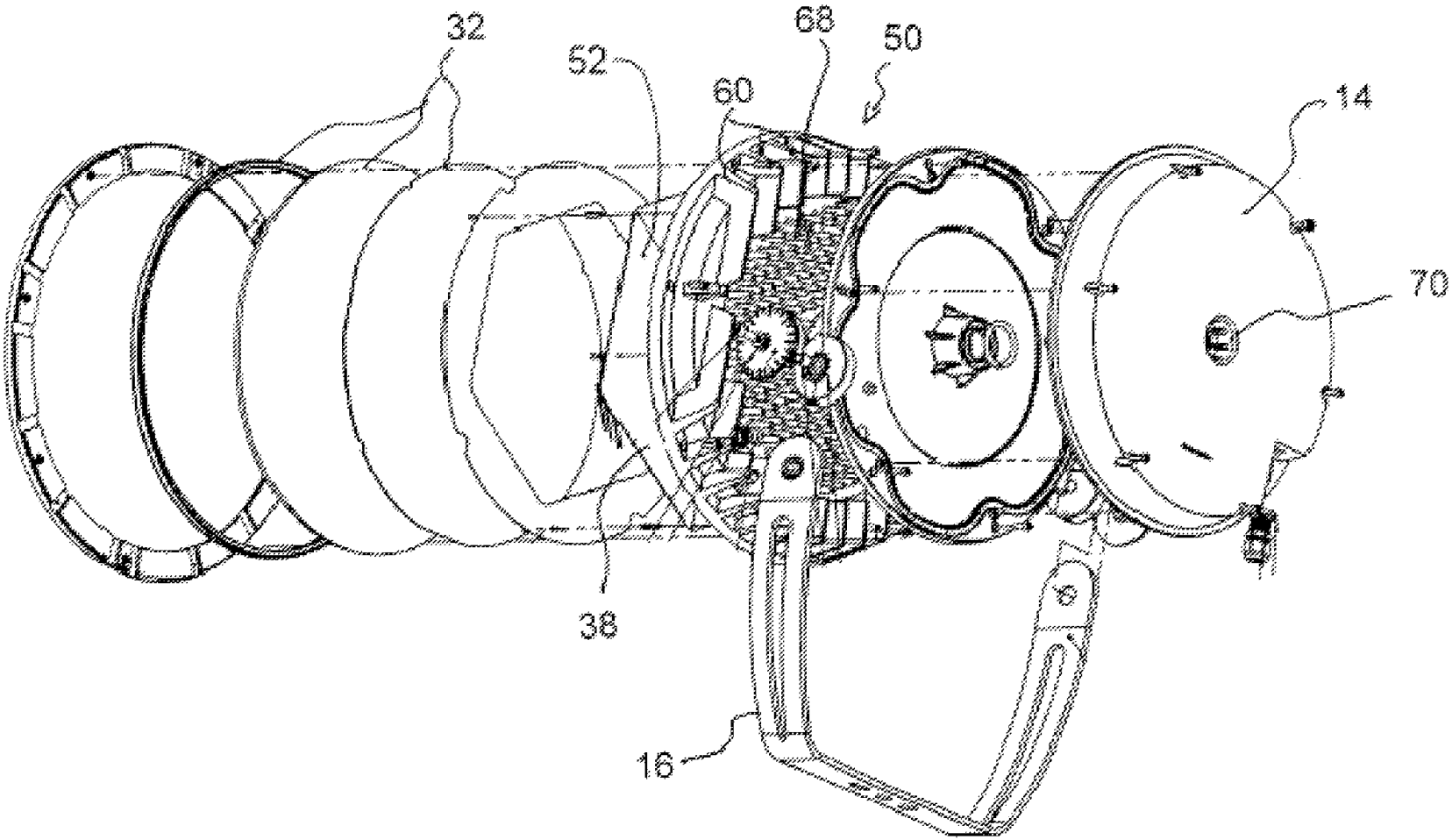
FIG. 3B is an exploded rear perspective view of the higher powered LED lighting unit of FIGS. 1A and 1B.

Referring now to the assembly of the LED array housing 12 and the power supply housing 14, as illustrated in FIGS. 3A and 3B, the LED array housing 12 is mounted to the power supply housing 14 via three or more perimeter support posts 54, e.g., typically between three and eight and preferably about 4 to 6 support posts 54, that extend between and interconnect the LED array housing 12 with the power supply housing 14. Each support post 54 of the example embodiment has a threaded recess, in a free remote end thereof, while the power supply housing 14 as a mating aperture, which permits a conventional threaded fastener to pass through the mating aperture to threadedly engage the threaded recess of the support post 54, thereby fixedly connecting the two housings to one another. Typically the support posts 54 are spaced about the periphery of the heat transfer element 50 so as not to hinder, as will be discussed below in further detail, the airflow through and along the heat transfer element 50.

It should be appreciated that support posts 54 generally mechanically connect and secure the LED array housing 12 to the power supply housing 14 while also preventing the direct conduction of heat from the LED array housing 12 to the power supply housing 14, or vice versa. That is, the support posts 54 of the LED lighting unit 10 are designed to minimize the transfer of heat from the LED array housing 12 to the power supply housing 14. Accordingly, the support posts 54 include one or more conventional thermally isolating elements or components, for example, and/or may have a reduced diameter end which minimizes the heat transfer capacity along the support post 54 to the power supply housing 14. Minimum lengths of the one or more support posts 54 are generally sufficient to maintain at least some degree of physical separation between the LED array housing 12 and the power supply housing 14.

In at least some embodiments, a cable conduit 56 also extends between the LED array housing 12 and the power supply housing 14. Such a cable conduit 56 generally includes a hollow internal passage, which facilitates the passage of associated leads or electrical wires between the power supply 34 and/or the control circuitry of LED array 28.

Figure 7B:
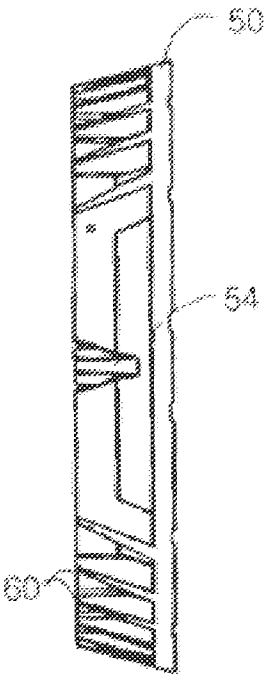
FIG. 7B is a diagrammatic right side elevational view of FIG. 7.
Figure 7:
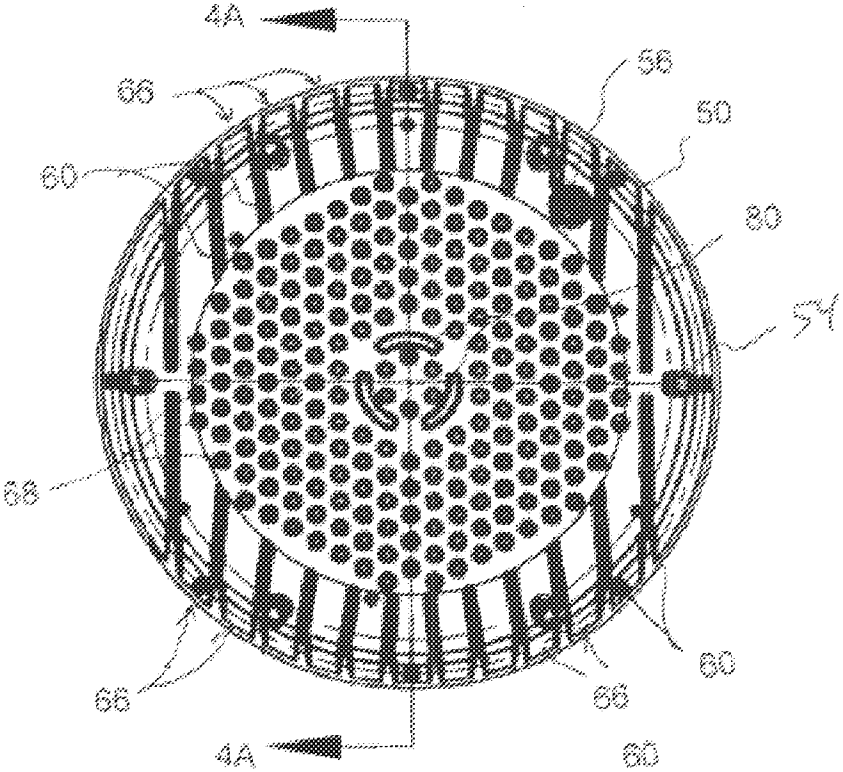
FIG. 7 is a diagrammatic top plan view of an embodiment of a heat transfer element.
Figure 7C:
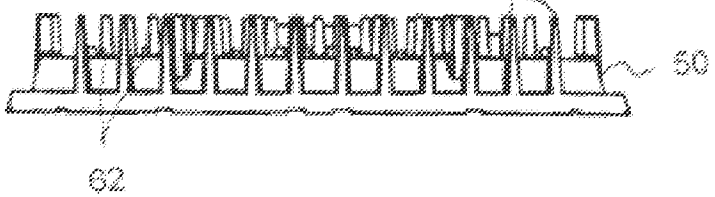
FIG. 7C is a diagrammatic bottom plan view of FIG. 7.

As best shown in FIGS. 3B, 7, 7A, 7B and 7C, the rear surface 26 of the LED array housing 12 is provided with multiple generally parallel extending heat dissipation elements 60, e.g., generally twelve spaced apart elongate members or ridges, which project into an airflow space 62 formed between the rear surface 26 of the LED array housing 12 and the front surface 58 of the power supply housing 14. As shown in FIG. 7, the two outer most heat dissipation elements 60 are both continuous and extend generally parallel to one another, from one lateral side to the opposite lateral side of the LED lighting unit 10, while the inner heat dissipation elements 60, located therebetween, are each discontinuous and generally extend radially inward and toward a central axis A of the LED lighting unit 10 which extends normal to the rear surface 26 of the LED array housing 12. Such arrangement of the inner heat dissipation elements 60 has a tendency of channeling and/or directing air radially inwardly and toward the central region of the airflow space 62, i.e., toward the central axis A, between the rear surface 26 of the LED array housing 12 and the front surface 58 of the power supply housing 14.

Each of the heat dissipation elements 60 of the illustrative example generally has the shape of a rectangular member or ridge, which extends radially inward into and provides access to the airflow space 62. Each generally rectangular shaped heat dissipation element 60 is thickest at its base where it is integrally connected with the rear surface 26 of the LED array housing 12 but becomes gradually thinner as the heat dissipation element 60 projects away from the base, extending upwards toward the power supply housing 14. It is to be appreciated that the heat dissipation elements 60 generally do not contact, but are each spaced from, the front surface 58 of the power supply housing 14 so as to avoid transferring or conducting heat thereto. The exposed peripheral edges of the heat dissipation elements 60 are generally smooth and/or rounded so as to allow the air to flow around and by those edges without causing undue turbulence to the air which, in turn, assists with increasing the airflow through the airflow space 62 and dissipation or removal of heat from heat dissipation elements 60 of the heat transfer element 50.

As illustrated, the heat dissipation elements 60 each generally extend from the rear surface 26 of the LED array housing 12 and toward the front surface 58 of the power supply housing 14 but are slightly spaced from the front surface 58 of the power supply housing 14, e.g., are spaced therefrom by a distance of about 0.25 inches or less, thereby forming a thermal isolation gap which thermally isolates the LED array housing 12 from the power supply housing 14 and significantly reduces the direct transfer of heat from the LED array housing 12, supporting the electrically powered LED array 28, to the power supply housing 14 containing the power supply 34.

It should be noted that the thermal conductivity between the heat dissipation elements 60 and the power supply housing 14 may also be reduced while allowing the heat dissipation elements 60 to be in contact with the power supply housing 14 by, for example, minimizing the surface contact area between each heat dissipation element 60 and the power supply housing 14 or by interposing a thermal isolation element, such as a thermally non-conductive spacer, between the leading edge of each heat dissipation element 60 and front surface 58 of the power supply housing 14.

In addition to providing heat dissipation areas for transferring heat from the LED array housing 12 to the surrounding air, the heat dissipation elements 60, the rear surface 26 of the LED array housing 12 and the adjacent front surface 58 of the power supply housing 14 together form multiple convective inlet passages 66 which allow inlet of convective airflow into the airflow space 62, which can remove heat from by the heat dissipation elements 60 during operation of the LED lighting unit 10, as will be discussed below.

The effectiveness and efficiency of this convective heat transfer is, as is well understood by those of skill in the relevant art, a function of the interior dimensions, the lengths and the number of convective circulation passages 66, as well as the surface characteristics of the heat dissipation elements 60, the rear surface 26 of the LED array housing 12 and the front surface 58 of the power supply housing 14. For example, the interior dimensions and the lengths and the characteristics of the interior surfaces of the convective inlet passages 66 as well as the shape or contour of the airflow space 62 determines the type, the velocity and the volume of the convective airflow that is allowed to flow into the convective inlet passages 66. As such, these features are significant factors in determining the overall efficiency and the rate of heat transfer from the heat dissipation elements 60 to the air flowing into the convective inlet passages 66 and contacting with and remove heat from the exposed surfaces of the heat dissipation elements 60 of the heat transfer element 50.

This example embodiment generally defines a total of 22 convective inlet passages 66 with 11 convective inlet passages 66 being located along each oppose lateral side of the LED lighting unit 10. That is, each convective inlet passage 66 is generally defined by a pair of adjacent heat dissipation elements 60 located on either side thereof as well as the rear surface 26 of the LED array housing 12 and the front surface 58 of the power supply housing 14. Accordingly, each heat dissipation passage 66 generally has a width of between approximately 0.3 to 1.5 inches preferable about 0.75 inches, a height of between approximately 1.0 to 2.0 inches preferable about 1.5 inches, and a length ranging between approximately 1.0 to 4.5 inches preferable about 3.25 inches or so, depending upon the location of the passage 66.

The heat dissipation elements 60 thereby provide a desired heat dissipation area for dissipating heat generated by the LED array 28 and transferred to the rear surface 26 of the LED array housing 12 while the non-conductive thermal isolation gaps 64, between the remote free ends of the heat dissipation elements 60 and the front surface 58 of the power supply housing 14, significantly reduce the transfer of any heat directly from the LED array housing 12 to the power supply housing 14 and thereby significantly reducing adverse mutual heating effects of the LED array 28 to the power supply 34.

In some embodiments, the rear surface 26 of the LED array housing 12 also accommodates multiple spaced apart generally cylindrical or conical pins 68 in addition to the generally rectangular shaped heat dissipation elements 60. For example, the rear surface 26 accommodates typically between 20 and 500 pins, more preferably between 100 and 300 pins, preferably about 206 pins (see FIG. 7), which extend generally normal to the rear surface 26 of the LED array housing 12. Each one of these cylindrical or conical pins 68 is generally uniformly spaced from each adjacent pin 68 and cooperates with the heat dissipation elements 60 to maximize a random convection airflow through the airflow space 62 as well as heat transfer from the cylindrical or conical pins 68 to the air so as to maximize cooling of the LED lighting unit 10. Typically each pin 68 is generally cylindrical in shape and has a diameter of between approximately 0.3 to 0.65 inches preferable about 0.35 inches and a height of between approximately 0.6 to 1.75 inches, preferable between about 0.9 and 1.5 inches. It is to be appreciated that the somewhat thinner pins 68 tend to provide more efficient transfer of the heat from the LED array housing 12 to the air than thicker pins 68 which tend to be less efficient.

Figure 7A:
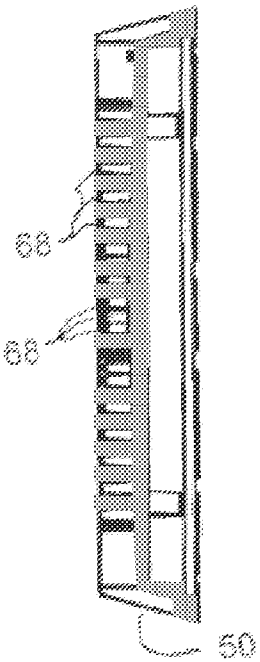
FIG. 7A is a diagrammatic cross-sectional view along section line 4A-4A of FIG. 7.

Each of the heat dissipation elements 60 has an approximate height of between approximately 0.6 to 1.75 inches, preferable between about 0.9 and 1.5 inches, measured relative to the rear surface 26 of the LED array housing 12, a width or thickness of approximately 0.25 to 0.45 inches, preferably about 0.4 inches, of an inch tapering or narrowing in a direction away from the rear surface 26, for example, with the taper being approximately 6°, and a length ranging from about 2 to 10 inches, depending upon their location across the diameter of the LED array housing 12, and may be spaced apart by a distance on the order of 1.0 to 1.5, preferably about 1.35 inches or so. As generally shown in FIG. 7A, the rear wall of the LED housing 12 may be domed or otherwise crowned so as to be located slightly closer to the front surface of the power source housing 14, i.e., decrease the height of the airflow space, and this configuration facilitates accelerating of the air as the air flows through the airflow space 62.

Figure 8:
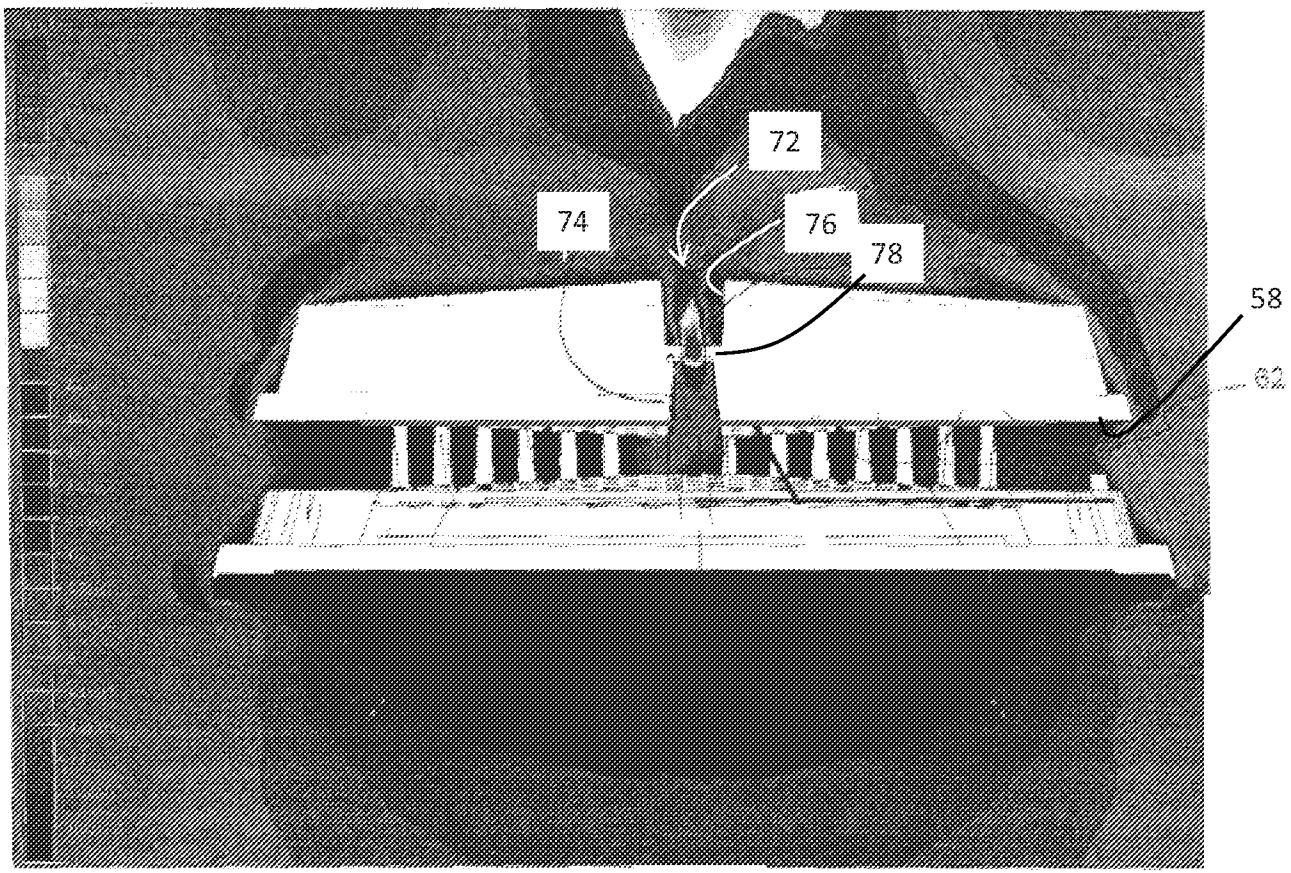
FIG. 8 is a diagrammatic cross-sectional view of an embodiment of a chimney accommodated within and extending through the power supply housing 14.

With reference now to FIG. 8, a detailed discussion concerning a chimney 70, which is formed in and extends through the power supply housing 14. As shown, the chimney 70 extends from the front surface 58 of the power supply housing 14 to the rear surface of the power supply housing 14 and thus forms a through opening 72 through a central region of the power supply housing 14. In the illustrative example, the chimney 70 includes first and second conically shaped sections 74, 76 which join with one another at a generally narrower throat section 78. That is, each one of the first and second conically shaped sections 74, 76 generally has a wider diameter at either the front surface 58 (e.g., having a diameter of between 1.0 inches to 2.5 inches, preferably about 2.12 inches) or the rear surface of the power supply housing 14 (e.g., having a diameter of between 1.0 inches to 2.5 inches, preferably about 1.94 inches) and a narrower diameter at the throat section 78 (e.g., having a diameter of between 0.75 inches to 1.5 inches, preferably about 1.0 to 1.2 inches). The chimney 70 is generally concentric with the central axis A of the LED lighting unit 10 as such positioning generally improves the airflow into and through the LED lighting unit 10.

In some embodiments, a central region of the heat transfer element 50 includes three arcuate walls 80 to assist with directing airflow into the chimney. These three arcuate walls 80 generally are arranged in an interrupted circle and are generally concentric with both the longitudinal axis A and the chimney 70. Six centrally located pins 68 are located within a region defined by the three arcuate walls 80 and these six pins 68 are generally separated from the remaining pins 68 by the three arcuate walls 80. These six centrally located pins 68 are in intimate communication with air for such air is directed into the chimney 70.

During operation of the LED lighting unit 10, the LEDs 30 generate heat which is conducted to and through the printed circuit board 38 and into the rear surface 26 of the LED array housing 12. As the heat transfer element 50 absorbs heat, ambient air naturally begins to flow into and through each one of the convective inlet passages 66 and into the airflow space 62 located between the rear surface 26 of the LED array housing 12 and the front surface 58 of the power supply housing 14. As this ambient air flows in through each one of the convective inlet passages 66 from a peripheral space between the rear surface 26 of the LED array housing 12 and the front surface 58 of the power supply housing 14, the air generally directed radially inwardly toward the central axis A of the LED lighting unit 10. As the cooler ambient air flows along this radially inward path, the air contacts with the exterior surface of the rectangular heat dissipation elements 60 and the heat is readily transferred from the rectangular heat dissipation element 60 to the air. Such heat transfer in effect cools the rectangular heat dissipation element 60 so that such elements may in turn conduct additional heat away from the LEDs 30.

For embodiments including pins 68, the air continues to flow radially inward, the air contacts one or more of the pins 68 and, as a result of such contact, additional heat is transferred from the pins 68 to the air which further increases the temperature of the air while simultaneously cooling the pins 68. Once the heated air generally reaches the central axis A, the heated air communicates with the three accurate walls and the six centrally located pins 68 before flowing into the chimney 70 and thus flowing axially along the central axis A and through the chimney 70 and out through the rear surface of the power supply housing 14. This airflow pattern, from the convective inlet passages 66 through the airflow space 62 and out through the chimney 70 maximizes convection airflow through the LED lighting unit 10 and thus achieves maximum cooling of the LED lighting unit 10.

As described, heat is transferred from the exterior surface of the rectangular heat dissipation elements 60 to air located within the airflow space 62, between the LED array housing 12 and the power supply housing 14. Such heating of air within the airflow space 62 reduces its density, also increasing its buoyancy. The heated air being more buoyant naturally rises. For arrangements in which the power supply housing 14 is located above the LED array housing 12, as would be for downward directed illumination, the rising heated air encounters the front surface 58 of the power supply housing 14. When configured with a chimney 70, at least a portion of the heated air is directed upward through the chimney 70, exiting the LED lighting unit 10. This creates an upward draft removing heated air from the airflow space 62 and creating a relative pressure drop within the airflow space 62 compared to ambient air. As a result of the relative pressure difference, ambient air is drawn into the airflow space 62, for example, through the inlet passages 66, heated and directed through the chimney 70 resulting in a continual natural draft-driven cooling process.

Figure 9:
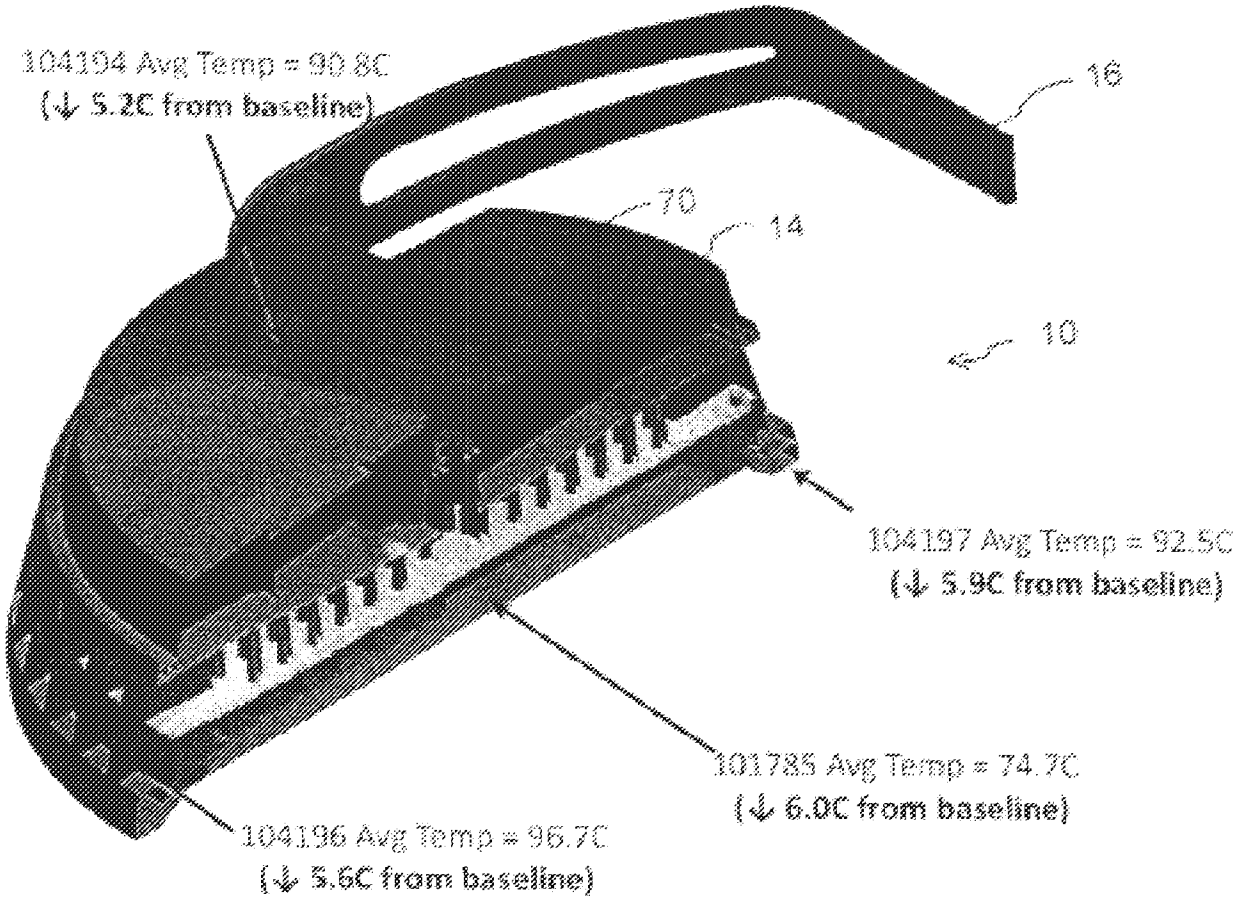
FIG. 9 is a diagrammatic cross-sectional view of the LED lighting unit of the first embodiment showing the measured average temperature readings for selected regions of the LED lighting unit according to the first embodiment.

With reference now to FIG. 9, the average temperature readings for four (4) different locations of the LED lighting unit 10, according to the first embodiment discussed above, are shown. For example, the average temperature for the rear surface of the LED lighting unit 10 is typically about 96.0° C., the average temperature at the outer edge of one of the rectangular heat dissipation element 60 of the LED lighting unit 10 is typically about 102.3° C., the average temperature for the front surface 36 of the circuit board of the LED lighting unit 10 is typically about 80.7° C., while the average temperature for the outer circumference edge of the front surface 24 of the LED array housing 12 is typically about 98.4° C. It is to be appreciated that this arrangement generally provides particularly efficient cooling of the LEDs 30 as well as the internal circuitry of the LED lighting unit 10. Nevertheless, the following discusses a couple of alternative arrangements for the rear surface 26 of the LED array housing 12. Moreover, it is to be appreciated that other modifications and/or alterations of the rear surface 26 of the LED array housing 12, in accordance with the teachings of the invention discussed above, would be readily apparent to those of ordinary skill in the art.

Figure 10B:
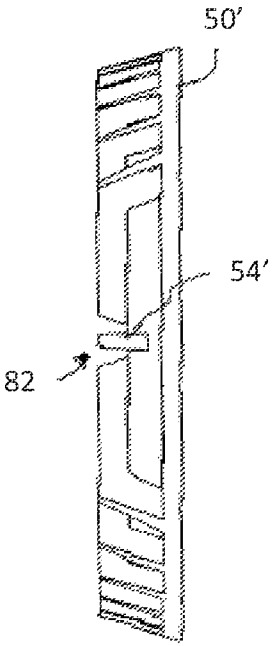
FIG. 10B is a diagrammatic right side elevational view of FIG. 10.
Figure 10:
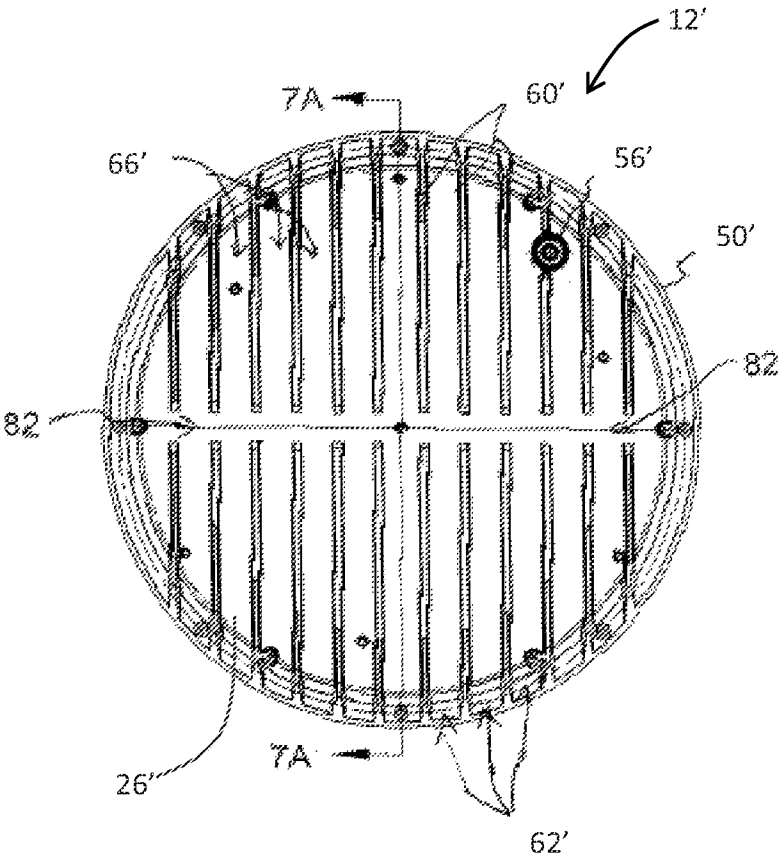
FIG. 10 is a diagrammatic top plan view of a second embodiment of the heat transfer element.
Figure 10A:
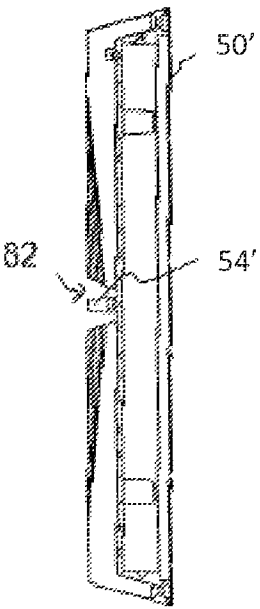
FIG. 10A is a diagrammatic cross-sectional view along section line 7A-7A of FIG. 10.

Turning now to FIGS. 10, 10A and 10B, a second alternative embodiment of a heat transfer element 50' will now be described. As this second embodiment is similar to the first embodiment in many respects, only the differences between the second embodiment and the first embodiment will be discussed in detail.

As best shown in FIG. 10, a rear surface 26' of the LED array housing 12' is provided with multiple generally parallel extending heat dissipation elements 60', e.g., generally twelve spaced apart elongate members 60', which project into elongated airflow spaces 62' disposed between the rear surface 26' of the LED array housing 12' and the front surface 58 of the power supply housing 14. Each one of the heat dissipation elements 60' generally extends parallel to one another from one lateral side to the opposite lateral side. In the illustrative embodiment, each one of the heat dissipation elements 60' is interrupted at mid section, thus forming an elongate channel 82. This elongate channel 82 extends normal to each one of the heat dissipation elements 60' and is coincident with a diameter of the LED lighting unit 10 which is also coincident with the central axis A of the LED lighting unit 10. Such arrangement of the heat dissipation elements 60' has a tendency of directing air radially inwardly and toward the elongate channel 82 where the air can then be directed radially outwardly along the elongate channel 82, i.e., in both directions along the elongate channel 82 away from the central axis A, and thus out of the airflow space 62' defined between the rear surface 26' of the LED array housing 12' and the front surface 58 of the power supply housing 14. This arrangement is somewhat useful in the event that a chimney 70 is not provided in the rear surface of the power supply housing 14. Alternatively, if so desired, this embodiment of the heat transfer element 50' can be used in combination with a chimney 70 so that the air enters along both lateral sides of the LED lighting unit 10, flows along the heat dissipation elements 60' and is eventually exhausted up through the chimney 70 provided in the power supply housing 14.

Figure 11:
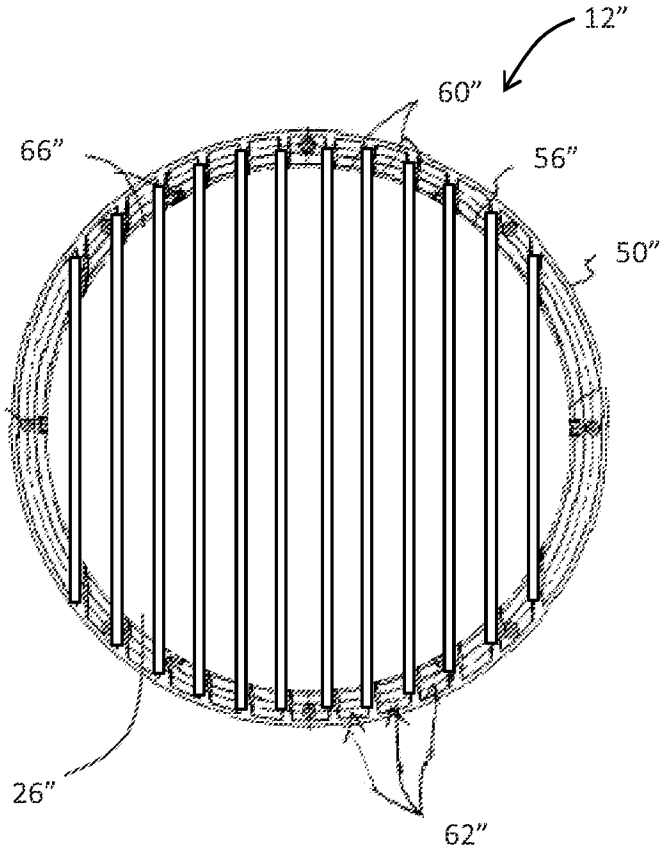
FIG. 11 is a diagrammatic perspective view of a third embodiment of the heat transfer element.

Turning now to FIG. 11, a third alternative version of the heat transfer element 50' will now be described. As this third embodiment is similar to the second embodiment in many respects, only the differences between the third embodiment and the second embodiment will be discussed in detail.

As shown in FIG. 11, the rear surface 26" of the LED array housing 12" is provided with multiple generally parallel extending heat dissipation elements 60", e.g., generally twelve spaced apart elongate members, which project into the airflow space 62" formed between the rear surface 26" of the LED array housing 12" and the front surface 58 of the power supply housing 14. Each one of the heat dissipation elements 60" generally extends parallel to one another from one lateral side to the opposite lateral side. Such arrangement of the heat dissipation elements 60" has a tendency of directing air from one lateral side to the opposite lateral side where the air can then be directed outward from the airflow space 62" defined between the rear surface 26 of the LED array housing 12" and the front surface 58 of the power supply housing 14. This arrangement is somewhat useful in the event that a chimney 70 is not provided in the rear surface of the power supply housing 14. Alternatively, if so desired, this embodiment of the heat transfer element 50" can be used in combination with a chimney 70 so that the air enters from both lateral sides of the LED lighting unit 10, flows along the heat dissipation elements 60" and is eventually exhausted up through the chimney 70 provided in the power supply housing 14.

Figure 12B:
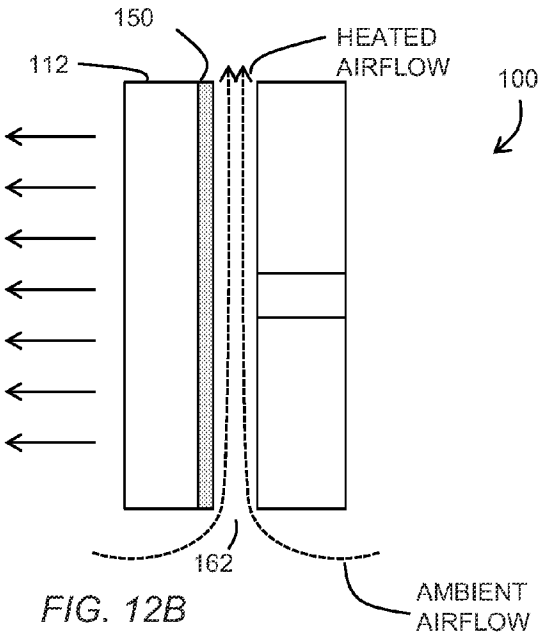
FIGS. 12A and 12B are respectively cross sectional schematic views of an embodiment of the LED lighting unit positioned for down lighting and side lighting applications.
Figure 12A:
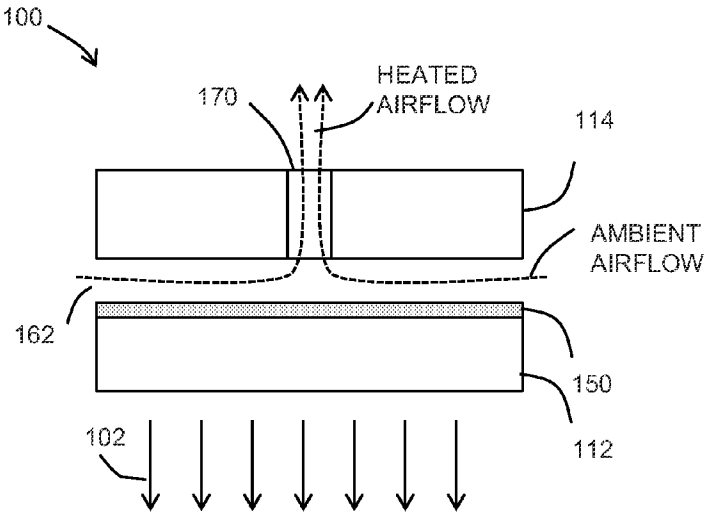

FIGS. 12A and 12B are respectively cross sectional schematic views of an embodiment of the LED lighting unit 100 positionable between downward (FIG. 12A) lighting and lateral (FIG. 12B) lighting applications. Such positioning can be accomplished, for example, with the standard mounting bracket can allow for vertical rotation of the lighting unit 100 about a horizontal axis HA (e.g., FIG. 1B). The LED lighting unit 100 includes an LED array housing 112 projecting illumination 102 in a preferred direction as shown. A heat transfer element 150 is mounted to a rear surface of the LED array housing 112, configured to draw heat away from internal lighting elements. The LED lighting unit 100 also includes a separate power supply housing 114 positioned in an overlapping, spaced-apart arrangement with the LED array housing 112. An airflow space 162 is defined between overlap of the two separate housings 112, 114. The power supply housing 114 includes a centrally located lumen, or chimney 70 extending through the power supply housing 114.

When positioned for downward illumination as shown in FIG. 12A, the heat transfer element 150 heats air within the airflow space 162, creating an upward draft through the chimney 170, as shown. The upward draft draws cooler ambient air laterally into the airflow space 162, which results in a continual cooling of the LED lighting unit 100.

When positioned for lateral illumination as shown in FIG. 12B, the heat transfer element heats air within the airflow space 162, creating an upward draft. Instead of being directed through the chimney 170, however, the heated air exits the airflow space 162 from a top portion of the void between the LED array housing and the power supply housing 114. In at least some embodiments, the heat transfer element 150 includes vertical passageways, such as flutes or openings between ridges and/or pins that are largely unobstructed to promote a draft according to the direction indicated by the arrows. When positioned between downward and lateral lighting, cooling can be enhanced by a combination of a portion of air heated within the airflow space 162 exiting through the chimney 170 and a portion exiting at an upper lateral region or edge of the airflow space 162. As the warm air naturally rises, the heated air will rise creating a draft drawing in cooler, ambient air at least through a lower lateral region or edge of the airflow space 162.

Figure 13:
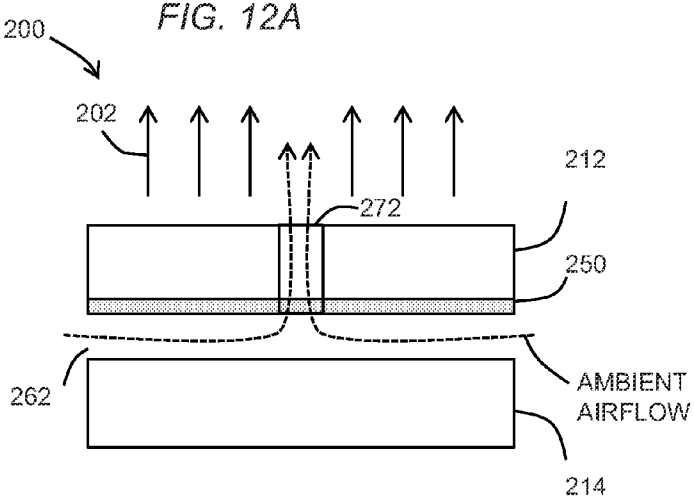
FIG. 13 is a cross sectional schematic view of an alternative embodiment of an LED lighting unit.

FIG. 13 is a cross sectional schematic view of an alternative embodiment of an LED lighting unit 200 for upward illumination. The LED lighting unit 200 includes an LED array housing 212 projecting illumination 202 in a preferred direction as shown. A heat transfer element 250 is mounted to a rear surface of the LED array housing 212, configured to draw heat away from internal lighting elements. The LED lighting unit 200 also includes a separate power supply housing 214 positioned in an overlapping, spaced-apart arrangement with the LED array housing 212. An airflow space 262 is defined between overlap of the two separate housings 212, 214. The LED array housing 212 includes a centrally located lumen, or chimney 272 extending through the LED array housing 212. The chimney 272 can take on any of various shapes, such as cylindrical, frusto-conical, and the other various chimney configurations described herein in relation to the power supply housing 14.

When positioned for upward illumination as shown, the heat transfer element 250 heats air within the airflow space 262, creating an upward draft through the chimney 272, as shown. The upward draft draws cooler ambient air laterally into the airflow space 262, which results in a continual cooling of the LED lighting unit 200.

Figure 14:
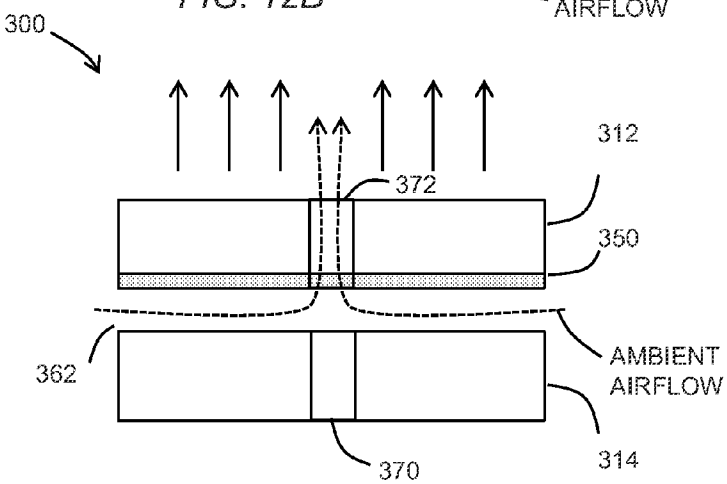
FIG. 14 is a cross sectional schematic view of another alternative embodiment of an LED lighting unit.

FIG. 14 is a cross sectional schematic view of another alternative embodiment of an LED lighting unit 300 including two chimneys 370, 372. A heat transfer element 350 heats air within an airflow space 362 located between a rear surface of the LED array housing 314 and a front surface of the power supply housing 314. A first chimney 370 is provided through the power supply housing 314 as described in relation to FIG. 12A. A second chimney 372 is provided through the LED array housing 312 as described in relation to FIG. 13. When combined with a standard mounting bracket that allows for vertical rotation of the lighting unit 300 about a horizontal axis HA (e.g., FIG. 1B), the LED lighting unit 300 can provide unassisted cooling in either upward, downward or lateral illumination positions.

Since certain changes may be made in the above described high power light emitting diode (LED) lighting unit for indoor and outdoor lighting functions, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Whereas many alterations and modifications of the present invention will no doubt become apparent to a person of ordinary skill in the art after having read the foregoing description, it is to be understood that the particular embodiments shown and described by way of illustration are in no way intended to be considered limiting. Further, the invention has been described with reference to particular preferred embodiments, but variations within the spirit and scope of the invention will occur to those skilled in the art. It is noted that the foregoing examples have been provided merely for the purpose of explanation and are in no way to be construed as limiting of the present invention.

While the present invention has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present invention in its aspects.

Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

We claim:

1. A solid-state lighting unit comprising:

a solid-state array housing defining an internal compartment and having at least one transparent lens for sealing the internal compartment;

at least a first solid-state lighting circuit card assembly disposed within the solid-state array housing, the first circuit card assembly comprising a common circuit card and a respective plurality solid-state lighting elements, each solid-state light element comprising a light emitting diode (LED) and a respective optical lens having a respective optical characteristic, wherein each respective optical lens of the first solid-state lighting circuit card assembly has substantially the same optical characteristics and combine to produce a first illumination beam width;

at least a second solid-state lighting circuit card assembly disposed within the solid-state array housing, the second circuit card assembly comprising a common circuit card and a respective plurality solid-state lighting elements, each solid-state light element comprising an LED and a respective optical lens having a respective optical characteristic, wherein each respective optical lens of the second solid-state lighting circuit card assembly has substantially the same optical characteristics and combine to produce a second illumination beam width, wherein the optical characteristic of each optical lens that produces the first illumination beam width of the first solid-state lighting circuit card assembly are different than the optical characteristic of each optical lens that produces a second illumination beam width of the second solid-state lighting circuit card assembly;

a controller in electrical communication with each circuit card assembly of the plurality of solid-state lighting circuit card assemblies, the controller configured to independently control each circuit card assembly of the plurality of solid-state lighting circuit card assemblies, wherein at least two circuit card assemblies are in operation at the same time to produce a single solid-state lighting unit having multiple beam widths; and wherein a portion of each circuit card assembly meets at a central point.

2. The solid-state lighting unit of claim 1, wherein a respective plurality of solid-state lighting elements of at least one circuit card assembly of the plurality of solid-state lighting circuit card assemblies comprise a first illumination color and a respective plurality of solid-state lighting elements of at least another circuit card assembly of the plurality of solid-state lighting circuit card assemblies comprise a second illumination color, different from the first illumination color.

3. The solid-state lighting unit of claim 1, wherein a respective plurality of solid-state lighting elements of at least one circuit card assembly of the plurality of solid-state lighting circuit card assemblies comprise a first illumination color temperature and a respective plurality of solid-state lighting elements of at least another circuit card assembly of the plurality of solid-state lighting circuit card assemblies comprise a second illumination color temperature, different from the first illumination color temperature.

4. The solid-state lighting unit of claim 1, wherein the plurality of solid-state lighting circuit card assemblies are arranged equidistant from the least one transparent lens.

5. The solid-state lighting unit of claim 4, wherein the plurality of solid-state lighting circuit card assemblies are coplanar.

6. The solid-state lighting unit of claim 1, wherein the plurality of solid-state lighting circuit card assemblies are shaped to substantially preserve a hexagonal close-pack arrangement of solid-state lighting elements of each respective solid-state lighting circuit card assembly across the plurality of solid-state lighting circuit card assemblies.

7. The solid-state lighting unit of claim 1, further comprising optics for controlling illumination of each solid-state lighting element of the plurality of solid-state lighting elements of each circuit card assembly of the plurality of solid-state lighting circuit card assemblies.

8. The solid-state lighting unit of claim 7, wherein the optics of at least one circuit card assembly of the plurality of solid-state lighting circuit card assemblies differ from optics of at least another circuit card assembly of the plurality of solid-state lighting circuit card assemblies.

9. A method for assembling a solid-state lighting unit, comprising:

providing a solid-state array housing defining an internal compartment and having at least one transparent lens for sealing the internal compartment, the solid-state array housing including multiple parallel extending heat dissipation elements, wherein an arrangement of the heat dissipation elements channels air radially inward toward a central axis of the solid-state lighting unit;

providing a plurality of common solid-state lighting circuit cards;

populating at least one circuit card of the plurality of common solid-state lighting circuit cards with a first plurality of solid-state lighting elements, each solid-state lighting element comprising a light emitting diode (LED) and a respective optical lens having a respective optical characteristic, wherein each respective optical lens of the first solid-state lighting circuit card assembly has substantially the same optical characteristics and combine to produce a first illumination beam width;

populating at least another circuit card of the plurality of common solid-state lighting circuit cards with a second plurality of different solid-state lighting elements, each solid-state light element comprising an LED and a respective optical lens having a respective optical characteristic, wherein each respective optical lens of the second solid-state lighting circuit card assembly has substantially the same optical characteristics and combine to produce a second illumination beam width;

disposing within the solid-state array housing, the populated circuit cards, wherein a portion of each circuit card assembly meets at a central point;

providing a controller in electrical communication with each populated solid-state lighting circuit card of the plurality of solid-state lighting circuit cards, the controller configured to independently control each populated solid-state lighting circuit card of the plurality of solid-state lighting circuit cards;

wherein the optical characteristic of each optical lens that produces the first illumination beam width of the first solid-state lighting circuit card assembly are different than the optical characteristic of each optical lens that produces a second illumination beam width of the second solid-state lighting circuit card assembly; and illuminating, at the same time, a surface with the first illumination beam width emanating from the first solid-state lighting circuit card assembly and the second illumination beam width emanating from the second solid-state lighting circuit card assembly.

10. The method of claim 9, wherein the first plurality of solid-state lighting elements comprise a first illumination color and the second plurality of solid-state lighting elements comprise a second illumination color, different from the first illumination color.

11. The method of claim 9, wherein the first plurality of solid-state lighting elements comprise a first illumination color temperature and the second plurality of solid-state lighting elements comprise a second illumination color temperature, different from the first illumination color temperature.

12. The method of claim 9, wherein the plurality of populated solid-state lighting circuit cards are arranged equidistant from the least one transparent lens.

13. The method of claim 12, wherein the plurality of populated solid-state lighting circuit cards are coplanar.

14. The method of claim 9, wherein disposing within the solid-state array housing, the populated circuit cards preserves a hexagonal close-pack arrangement of solid-state lighting elements of each respective populated solid-state lighting circuit card across the plurality of populated solid-state lighting circuit cards.

15. The method of claim 9, further comprising providing optics for controlling illumination of each solid-state lighting element of the plurality of solid-state lighting elements of each populated circuit card of the plurality of populated solid-state lighting circuit cards.

16. The method of claim 15, wherein the optics of at least one populated circuit card of the plurality of populated solid-state lighting circuit cards differ from optics of at least another populated circuit card of the plurality of populated solid-state lighting circuit cards.

* * * * *